US006898406B2

(12) United States Patent
Suzuki et al.

(10) Patent No.: US 6,898,406 B2
(45) Date of Patent: May 24, 2005

(54) DEVELOPING DEVICE HAVING A DEVELOPER FORMING A MAGNET BRUSH

(75) Inventors: Yuji Suzuki, Tokyo (JP); Naohito Shimota, Shizuoka (JP); Bing Shu, Shizuoka (JP); Koji Suzuki, Kanagawa (JP); Akihiro Itoh, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/355,039

(22) Filed: Jan. 31, 2003

(65) Prior Publication Data

US 2003/0152403 A1 Aug. 14, 2003

(30) Foreign Application Priority Data

Jan. 31, 2002 (JP) ..... 2002-023367
Jan. 31, 2002 (JP) ..... 2002-023399
Mar. 1, 2002 (JP) ..... 2002-055216

(51) Int. Cl.[7] ..... G03G 15/09
(52) U.S. Cl. ..... 399/277
(58) Field of Search ..... 399/267, 277, 399/275

(56) References Cited

U.S. PATENT DOCUMENTS 4,637,973 A * 1/1987 Shigeta et al. ..... 399/267
5,202,730 A * 4/1993 Fuji et al. ..... 399/277
5,220,383 A 6/1993 Enoki et al.
5,245,391 A 9/1993 Suzuki et al.
5,311,263 A 5/1994 Suzuki et al.
5,339,141 A 8/1994 Suzuki et al.
5,378,739 A 1/1995 Koike et al.
5,394,231 A 2/1995 Sudo et al.
5,424,814 A 6/1995 Suzuki et al.
5,450,172 A 9/1995 Suzuki et al.
5,467,175 A 11/1995 Takagaki et al.
5,691,099 A 11/1997 Kusakata et al.
5,812,917 A 9/1998 Iwata et al.
5,828,936 A * 10/1998 Shimizu et al. ..... 399/275
6,112,046 A 8/2000 Suzuki et al.
6,421,520 B2 * 7/2002 Masuda et al. ..... 399/277
6,442,364 B2 * 8/2002 Kai et al. ..... 399/277
6,525,753 B2 2/2003 Matsuda
6,701,114 B2 * 3/2004 Sekine et al. ..... 399/267
2002/0154917 A1 * 10/2002 Aoki et al.

FOREIGN PATENT DOCUMENTS

JP 09281740 A * 10/1997 ..... G03G/15/09
JP 2000-47476 2/2000
JP 2000-305355 11/2000
JP 2000-305360 11/2000
JP 2000-347506 12/2000

(Continued)

OTHER PUBLICATIONS

U.S. Appl. No. 10/821,898, filed Apr. 12, 2004, Suzuki et al.
U.S. Appl. No. 10/760,452, filed Jan. 21, 2004, Higuchi et al.

(Continued)

*Primary Examiner*—Susan Lee
(74) *Attorney, Agent, or Firm*—Oblon, Spivak, McClelland, Maier & Neustadt, P.C.

(57) ABSTRACT

In a developing device having a developing zone where an image carrier and a developer carrier face each other, the developer carrier carrying a developer thereon moves at a linear velocity of 150 mm/sec or above, but below 500 mm/sec. The amount of the developer conveyed to the developing zone by the developer carrier is between 65 mg/cm$^2$ and 95 mg/cm$^2$. A magnetic flux generated on the developer carrier in the developing zone by a magnetic pole has a flux density having an attenuation ratio of 40% in the direction normal to the developer carrier. The flux density in the direction normal to the developer carrier, as measured on the surface of the developer carrier, is between 100 mT and 200 mT. Magnetic grains, which constitute the developer together with toner grains, have a saturation magnetization value of $40\times10^{-7}\times4$ πWb·m/kg or above, but below $50\times10^{-7}\times4$ πWb·m/kg.

42 Claims, 21 Drawing Sheets

FOREIGN PATENT DOCUMENTS

| | | | | |
|---|---|---|---|---|
| JP | 2001-5296 | | 1/2001 | |
| JP | 2001-27829 | | 1/2001 | |
| JP | 2001100532 A | * | 4/2001 | ..... G03G/15/09 |
| JP | 2001-290305 | | 10/2001 | |
| JP | 2002-268386 | | 9/2002 | |
| JP | 2002-287503 | | 10/2002 | |

OTHER PUBLICATIONS

U.S. Appl. No. 10/759,197, filed Jan. 20, 2004, Emoto et al.
U.S. Appl. No. 10/757,526, filed Jan. 15, 2004, Shu et al.
U.S. Appl. No. 10/793,320, filed Mar. 5, 2004, Higuchi et al.
U.S. Appl. No. 10/666,254, filed Sep. 22, 2003, Kondo et al.
U.S. Appl. No. 10/712,026, filed Nov. 14, 2003, Tomita et al.
U.S. Appl. No. 10/724,260, filed Dec. 1, 2003, Emoto et al.
U.S. Appl. No. 10/680,091, filed Oct. 8, 2003, Omata et al.
U.S. Appl. No. 10/650,754, filed Aug. 29, 2003, Koichi et al.
U.S. Appl. No. 10/645,614, filed Aug. 22, 2003, Sohmiya et al.
U.S. Appl. No. 10/631,727, filed Aug. 1, 2003, Suzuki et al.
U.S. Appl. No. 09/905,872, filed Jul. 17, 2001, Sasaki et al.
U.S. Appl. No. 09/965,826, filed Oct. 1, 2001, Higuchi et al.
U.S. Appl. No. 09/828,877, filed Oct. 22, 2001, Sasaki et al.
U.S. Appl. No. 09/996,585, filed Nov. 30, 2001, Higuchi et al.
U.S. Appl. No. 10/020,925, filed Dec. 19, 2001, Mochizuki et al.
U.S. Appl. No. 10/101,978, filed Mar. 21, 2002, Sugiyama et al.
U.S. Appl. No. 10/058,352, filed Jan. 30, 2002, Yoshiki.
U.S. Appl. No. 10/075,462, filed Feb. 15, 2002, Terai.
U.S. Appl. No. 10/077,813, filed Feb. 20, 2002, Matsuda et al.
U.S. Appl. No. 10/077,752, filed Feb. 20, 2002, Iwamoto et al.
U.S. Appl. No. 10/102,853, filed Mar. 22, 2002, Ikeda.
U.S. Appl. No. 10/101,756, filed Mar. 21, 2002, Sasaki et al.
U.S. Appl. No. 10/151,103, filed May 21, 2002, Kondo et al.
U.S. Appl. No. 10/158,069, filed May 31, 2002, Matsuda et al.
U.S. Appl. No. 10/176,578, filed Jun. 24, 2002, Yagi et al.

* cited by examiner

FIG. 9

| SUBSTANCE | PARTS |
|---|---|
| POLYESTER RESIN | 90 |
| ESTER WAX (GRAIN SIZE: 400 μm) | 5 |
| CARBON BLACK | 5 |
| METAL-CONTAINING MONO-AZO DYE | 1 |

FIG. 10

| SUBSTANCE | PARTS |
|---|---|
| SILICONE RESIN (20%) | 120 |
| γ-(2-AMINOETHYL) AMINOPROPYL TRIMETHOXYSILANE | 3 |
| CARBON BLACK | 4 |
| TOLUENE | 80 |

FIG. 11

| SUBSTANCE | PARTS |
|---|---|
| SILICONE RESIN (20%) | 120 |
| γ-(2-AMINOETHYL)AMINOPROPYL TRIMETHOXYSILANE | 3 |
| CARBON BLACK | 3 |
| TOLUENE | 80 |

FIG. 12

| SUBSTANCE | PARTS |
|---|---|
| SILICONE RESIN (20%) | 120 |
| γ-(2-AMINOEHYL)AMINOPROPYL TRIMETHOXYSILANE | 3 |
| CARBON BLACK | 1 |
| TOLUENE | 80 |

FIG. 14

| CARRIER | NUMBER OF WHITE SPOTS/PRINT |
|---|---|
| C1 | 38.3 |
| C2 | 14.9 |
| C3 | 10.6 |

FIG. 15

| CARRIER | NUMBER OF WHITE SPOTS/PRINT |
|---|---|
| C1 | 38.3 |
| C4 | 7.9 |
| C5 | 10.5 |

FIG. 16

| CARRIER | NUMBER OF WHITE SPOTS/PRINT |
|---|---|
| C5 | 10.5 |
| C6 | 12.9 |
| C7 | 7.8 |

FIG. 17

| CARRIER | NUMBER OF WHITE SPOTS/PRINT |
|---|---|
| C8 | 6.9 |
| C9 | 12.6 |

FIG. 18

| CARRIER | NUMBER OF WHITE SPOTS/PRINT |
|---|---|
| C 10 | 25.8 |
| C 11 | 9.6 |
| C 12 | 4.3 |

FIG. 19

| CARRIER | NUMBER OF WHITE SPOTS/PRINT |
|---|---|
| C 10 | 25.8 |
| C 13 | 8.7 |
| C 14 | 12.6 |

FIG. 20

| CARRIER | NUMBER OF WHITE SPOTS/PRINT |
|---|---|
| C14 | 12.6 |
| C15 | 14.8 |
| C16 | 8.4 |

FIG. 21

| CARRIER | NUMBER OF WHITE SPOTS/PRINT |
|---|---|
| C17 | 7.9 |
| C18 | 11.3 |

FIG. 26

| CARRIER | WEIGHT OF CARRIER GRAINS (mg / 1,000 PRINTS) | |
|---|---|---|
| | P1c PLACEMENT ANGULAR WIDTH 35 [°] | P1c PLACEMENT ANGULAR WIDTH 45 [°] |
| C19 | 10.7 | 3.1 |
| C20 | 4.13 | 1.2 |
| C21 | 1.72 | 0.5 |

FIG. 27

| CARRIER | WEIGHT OF CARRIER GRAINS (mg / 1,000 PRINTS) | |
|---|---|---|
| | P1 PLACEMENT ANGULAR WIDTH 35 [°] | P1c PLACEMENT ANGULAR WIDTH 45 [°] |
| C19 | 10.7 | 3.1 |
| C22 | 3.6 | 1.1 |
| C23 | 5.3 | 1.5 |

FIG. 28

| CARRIER | WEIGHT OF CARRIER GRAINS (mg/1,000 PRINTS) | |
|---|---|---|
| | P1c PLACEMENT ANGULAR WIDTH 35 [°] | P1c PLACEMENT ANGULAR WIDTH 45 [°] |
| C 23 | 5. 3 | 1. 5 |
| C 24 | 6. 3 | 1. 8 |
| C 25 | 3. 5 | 1. 0 |

FIG. 29

| CARRIER | WEIGHT OF CARRIER GRAINS (mg/1,000 PRINTS) | |
|---|---|---|
| | P1c PLACEMENT ANGULAR WIDTH 35 [°] | P1c PLACEMENT ANGULAR WIDTH 45 [°] |
| C 26 | 3. 3 | 0. 8 |
| C 27 | 4. 7 | 1. 3 |

DEVELOPING DEVICE HAVING A DEVELOPER FORMING A MAGNET BRUSH

BACKGROUND OF THE INVENTION

1. Field of the Invention

The present invention relates to a developing device for a copier, printer, facsimile apparatus or similar image forming apparatus and an image forming apparatus using the same. More particularly, the present invention relates to a developing device of the type causing a developer to form a magnet brush on a developer carrier in a developing zone where the developer carrier faces an image carrier to thereby develop a latent image formed on the image carrier, and an image forming apparatus using the same.

2. Description of the Background Art

It is a common practice with an electrophotographic, electrostatic or similar image forming apparatus to form a latent image on a drum, belt or similar image carrier in accordance with image data and develop it with a developing device for thereby producing a corresponding toner image. Today, a two-ingredient type developer made up of toner and carrier is predominant over a single-ingredient type developer, i.e., toner because it is desirable in image transferability, halftone reproducibility, and stability against temperature and humidity.

In a developing device of the type using a two-ingredient type developer, the developer is caused to rise on a developer carrier in the form of a magnet brush and conveyed to a developing zone where the developer carrier faces an image carrier. In the developing zone, the magnet brush rubs the surface of the image carrier with the result that the toner is fed from the magnet brush to a latent image formed on the image carrier for thereby developing the latent image.

In the developing device of the type described, the developer carrier is usually made up of a cylindrical sleeve and a magnet roller accommodated in the sleeve and provided with a plurality of magnetic poles. The magnet roller forms a magnetic field for causing the developer to rise on the sleeve surface in the form of a magnet brush. The sleeve moves relative to the magnet roller for thereby conveying the developer to the developing zone. In the developing zone, the developer forms brush chains along magnetic lines of force issuing from the magnetic pole for development, forming a magnet brush. The magnet brush contacts the surface of the image carrier while deforming in accordance with the movement of the sleeve surface, thereby feeding the toner to the latent image.

As the distance between the image carrier and the sleeve in the developing zone decreases, image density increases while a so-called edge effect decreases, as known in the art. In this sense, the above distance should be as small as possible. However, when the distance is reduced, it is likely that the trailing edge of a black or halftone solid image is lost or that the reproducibility of thin lines is lowered, degrading image quality.

In the developing zone, the surface of the sleeve moves in the same direction as, but at a higher linear velocity than, the surface of the image carrier. Therefore, the magnet brush moves relative to the latent image of the image carrier in such a manner as to rub the latent image while outrunning it. Paying attention to a portion of the latent image corresponding to the tailing edge of an image, brush chains rubbing the above portion one after another have a toner feeding ability that sequentially decreases, as will be described more specifically hereinafter.

Part of the magnet brush entered the developing zone and rubbing the trailing edge portion of the latent image is the part that has faced the non-image portion of the image carrier positioned at the upstream side in the direction of movement of the image carrier. On the tips of brush chains forming the above part of the magnet brush, toner grains deposited on carrier grains have been shifted toward the sleeve due to the electrostatic force of the non-image portion. This phenomenon is generally referred to as toner drift. Toner drift becomes more noticeable as a period of time over which the brush chains face the non-image portion increases. As a result, the brush chains rubbing the trailing edge portion of the latent image at the downstream portion of the developing zone have faced the non-image portion over a longer period of time than the brush chains rubbing it at the upstream side of the developing zone. It follows that toner drift is more conspicuous on the former brush chains than on the latter brush chains and reduces the number of toner grains present on the individual carrier grain, thereby reducing the toner feeding ability.

Subsequently, when the trailing edge portion of the latent image moves out of the developing zone, the brush chains rubbing it have hardly any toner grains on their carrier grains. When toner drift on the brush chains goes so far, the carrier grains of the brush chains electrostatically attract toner grains deposited on the trailing edge portion of the latent image. Consequently, despite that the toner grains have been fed from the brush chains to the trailing edge portion of the latent image, the toner grains are returned to the other brush chains having hardly any toner on the carrier grains before they leave the developing zone. This is presumably the cause of the omission of the trailing edge and the degradation of thin line reproducibility.

To reduce the omission of the trailing edge of an image and the degradation of thin line reproducibility, Japanese Patent Laid-Open Publication Nos. 2000-305360, 2000-347506 and 2001-5296, for example, each propose a particular attenuation ratio of a flux density in the normal direction in the developing region, a particular angular distance between a main magnetic pole for forming a magnet brush and a magnetic pole adjoining it, and a particular half-value center angle of the main pole. More specifically, a single main magnetic pole (N pole) and two auxiliary magnetic poles (S poles) respectively positioned upstream and downstream of the main pole in the direction of movement of the sleeve surface constitute the magnetic pole for development.

Japanese Patent Laid-Open Publication No. 2001-27849 proposes a particular nip for development and particular density of a magnet brush. Also, Japanese Patent Laid-Open Publication No. 2001-134100 proposes a particular half-value angular width or half-value center angle of a main magnetic pole. With such particular configurations, it is possible to enhance developing efficiency, reduce the omission of the trailing edge of an image, and improve thin line reproducibility.

In accordance with the prior art technologies stated above, to enhance developing efficiency, reduce the omission of the trailing edge of an image and improve thin line reproducibility, the ratio of the linear velocity of the sleeve to that of the image carrier, as measured in the developing zone, is increased to allow a sufficient amount of toner to be fed to a latent image.

While the linear velocity ratio mentioned above may be increased by lowering the linear velocity of the image carrier or raising the linear velocity of the sleeve, the latter scheme is usually used because the former scheme lowers image forming speed. However, when the linear velocity of the sleeve is raised, a centrifugal force acting on the developer deposited on the sleeve is intensified. As a result, carrier grains forming the magnetic brush are apt to part from the magnet brush due to, e.g., a shock to occur when the magnet brush contacts the image carrier, flying out of the developing device. This phenomenon will hereinafter be referred to as carrier scattering. The carrier grains flown out of the developing device deposit on the image carrier and various parts and devices arranged therearound. The carrier grains deposited on the image carrier disturb an image or cause the dots of an image to be partly lost, thereby lowering image quality. In addition, the carrier grains deposited on parts and devices around the developing device are likely to damage them.

Today, there are extensively used an image forming apparatus with relatively high image forming speed in which the linear velocity of the image carrier is between 100 mm/sec and 300 mm/sec (medium speed) and an image forming apparatus with high image forming speed in which the linear velocity is between 300 mm/sec and 600 mm/sec (high speed). In such a medium-speed or a high-speed image forming apparatus, the linear velocity of the sleeve and therefore centrifugal force to act on the developer deposited on the sleeve are further increased, so that the problems discussed above are more likely to occur.

By a series of researches and experiments, we found that in the conventional developing devices an electrostatic force exerted by the image carrier caused the carrier grains positioned on the tips of the brush chains in the developing zone to deposit on the image carrier. More specifically, it has been customary to cause the magnet brush to rub, or move relative to, the surface of the image carrier for thereby feeding more toner to a latent image than when the magnet brush moves at the same speed as the surface of the image carrier. In this condition, in the developing zone, part of the magnet brush not contacting the surface of the image carrier, i.e., adjoining the sleeve moves relative to the surface of the image carrier. However, the other part of the magnet brush contacting the surface of the image carrier, in many cases, adhere to the surface of the image carrier, but does not rub it. Therefore, the effect achievable with the conventional developing device is limited. This is also true with a developing device in which the magnet brush is short and is dense in its portion contacting the image carrier. The effect achievable with this kind of developing device is also limited even when the linear velocity ratio of the sleeve to the image carrier is increased.

As for carrier scattering, experiments showed that not only the centrifugal force but also the following two factors should be taken into account. First, in the developing zone, the carrier grains on the tips of the brush chains are subject to the composite force of the centrifugal force and electrostatic force and tend to part from the magnet brush. Second, the above carrier grains are subject to the composite force of the centrifugal force and gravity and also tend to part from the magnet brush. These factors will be described more specifically later.

Technologies relating to the present invention are also disclosed in, e.g., Japanese Patent Laid-open Publication Nos. 2000-47476, 2000-305355, 2001-27829, 2001-290305, 2002-268386 and 2002-287503.

SUMMARY OF THE INVENTION

It is a first object of the present invention to provide a developing device capable of reducing, when applied to the medium-speed image forming apparatus whose image carrier moves at the linear velocity of 100 mm/sec or above, but 200 mm/sec or below, carrier deposition on the image carrier while improving the reproducibility of thin lines and reducing the omission of the trailing edge of an image, and an image forming apparatus using the same It is a second object of the present invention to provide a developing device capable of reducing, when applied to the high-speed image forming apparatus whose image carrier moves at the linear velocity of 300 mm/sec or above, but 600 mm/sec or below, carrier deposition on the image carrier while improving the reproducibility of thin lines and reducing the omission of the trailing edge of an image, and insuring high image density, and an image forming apparatus using the same.

It is a third object of the present invention to provide a developing device capable of reducing carrier scattering while enhancing the reproducibility of thin lines and reducing the omission of the trailing edge of an image even when applied to the high-speed image forming apparatus.

In accordance with the present invention, a developing device includes an image carrier and a developer carrier facing each other in a developing zone. The developer carrier carrying a developer thereon moves at a linear velocity of 150 mm/sec or above, but below 500 mm/sec. The amount of the developer conveyed to the developing zone by the developer carrier is between 65 mg/cm$^2$ and 95 mg/cm$^2$. A magnetic flux generated on the developer carrier in the developing zone by a magnetic pole has a flux density having an attenuation ratio of 40% in the direction normal to the developer carrier. The flux density in the direction normal to the developer carrier, as measured on the surface, is between 100 mT and 200 mT. Magnetic grains, which constitute the developer together with toner grains, have a saturation magnetization value of $40\times10^{-7}\times4\ \pi$Wb·m/kg or above, but below $50\times10^{-7}\times4\ \pi$Wb·m/kg.

BRIEF DESCRIPTION OF THE DRAWINGS

The above and other objects, features and advantages of the present invention will become more apparent from the following detailed description taken with the accompanying drawings in which:

FIG. 9 is a table listing the composition of toner used for experiments relating to a first embodiment of the present invention;

FIGS. 10 through 12 are tables each listing a particular composition of a carrier also used for the experiments of the first embodiment;

FIGS. 14 through 17 are tables listing the results of the experiments of the first embodiment conducted with carriers C1 through C9;

FIGS. 18 through 21 are tables listing the results of experiments relating to a second embodiment of the present invention and conducted with carriers C10 through C18;

FIGS. 26 through 29 are tables listing the results of experiments relating to the third embodiment and conducted with carriers C19 through C27.

DESCRIPTION OF THE PREFERRED EMBODIMENTS

To better understand the present invention, why the conventional technologies taught in Laid-Open Publication Nos. 2000-305360, 2000-347506 and 2001-5296 are capable of reducing the omission of the trailing edge of an image and enhancing the reproducibility of thin lines will be described first.

Figure 1A:
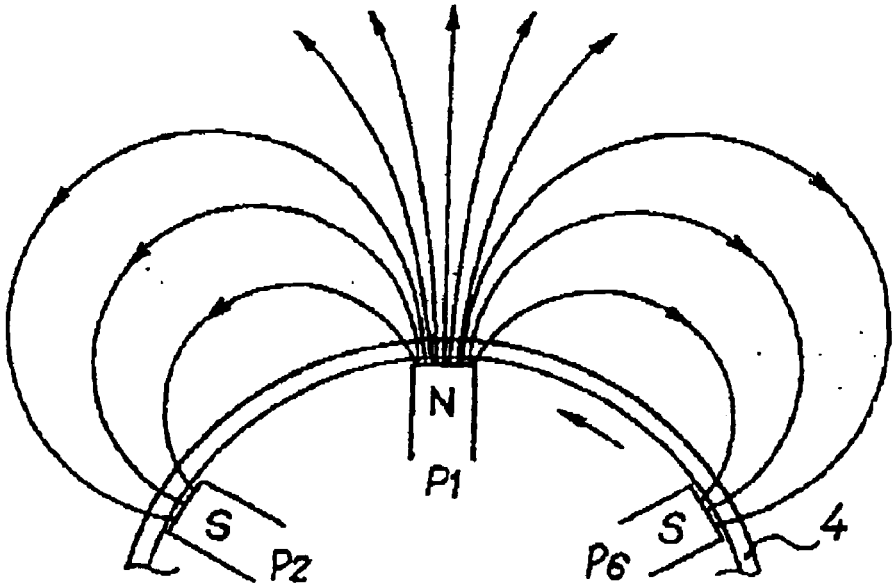
FIG. 1A PRIOR ART
FIG. 1A shows a magnetic force distribution around a developing zone in a conventional developing device in which a single magnetic pole contributes to development.
Figure 1B:
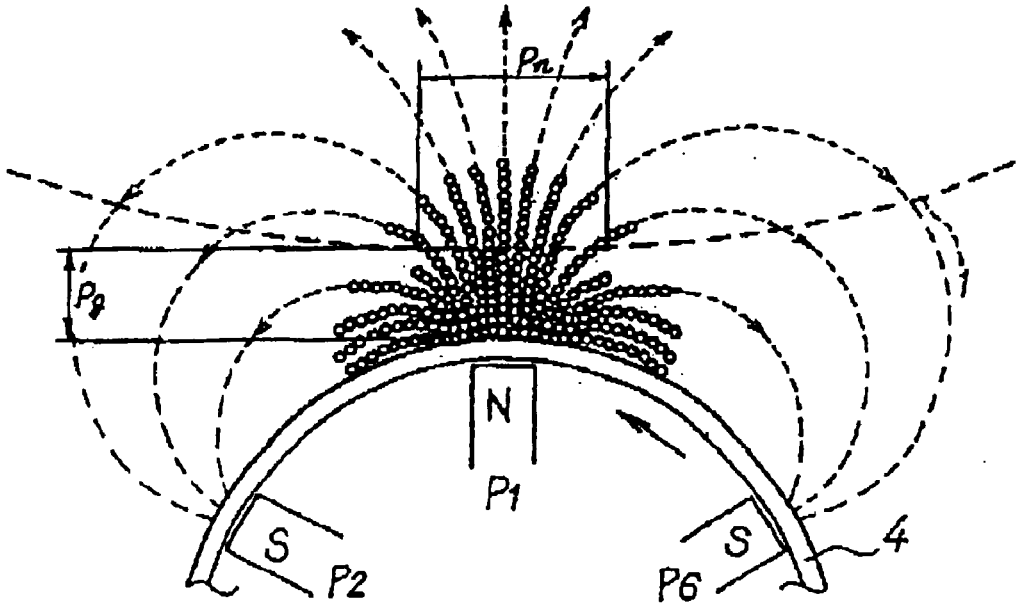
FIG. 1B PRIOR ART
FIG. 1B shows a developer forming a magnet brush under the magnetic force of a magnetic field formed by the magnetic pole of FIG. 1A, as seen from the axis of a sleeve.
Figure 2A:
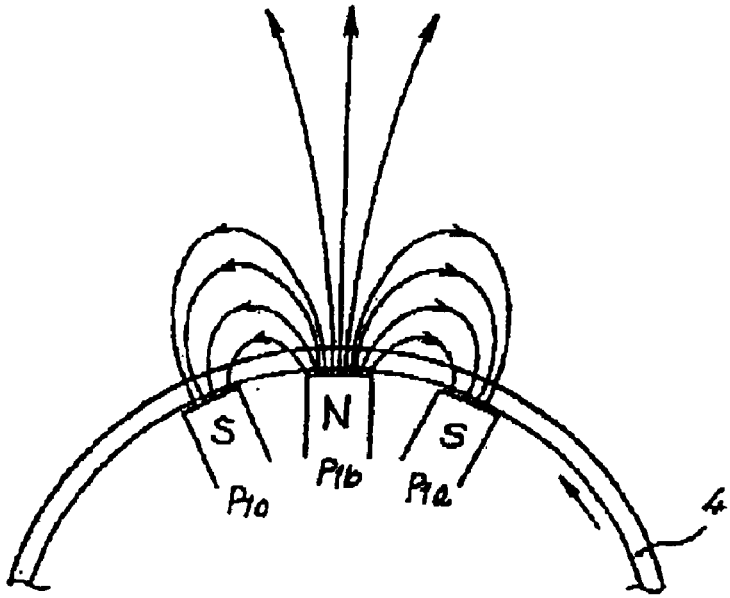
FIG. 2A PRIOR ART
FIG. 2A shows a magnetic force distribution around a developing zone in another conventional developing device in which a single main magnetic pole and two auxiliary magnetic poles contribute to development.
Figure 2B:
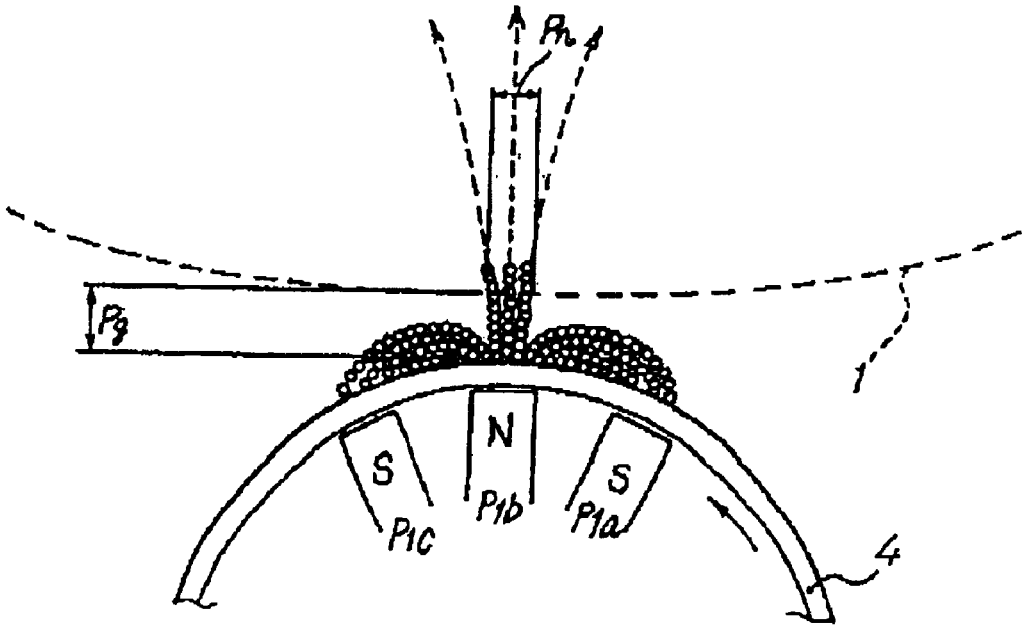
FIG. 2B PRIOR ART
FIG. 2B shows a developer forming a magnet brush under the magnetic force of a magnetic field formed by the magnetic poles of FIG. 2A, as seen from the axis of a sleeve.

FIG. 1 shows a magnetic force distribution established around a developing zone by a single magnetic pole P1 (N pole) for development in a conventional developing device (Prior Art 1 hereinafter). FIG. 1B shows a magnet brush formed by a developer due to a magnetic field formed by the main pole P1, as seen in the axial direction of a sleeve 4. FIG. 2A shows a magnetic force distribution formed around a developing zone by a main magnetic pole. P1*b* (N pole) and two auxiliary magnetic poles P1*a* and P1*c* (S poles) in another conventional developing device (Prior Art 2 hereinafter). FIG. 2B shows a magnet brush formed by a developer due to a magnetic field formed by the magnetic poles P1*a* through P1*c*, as seen in the axial direction of a sleeve 4.

In Prior Art 1 shown in FIGS. 1A and 1B, a magnetic pole P2 (S pole) is positioned downstream of the developing zone in the direction of rotation of the sleeve 4 for conveying the developer. Another magnetic pole P6 (S pole) is positioned upstream of the developing zone in the above direction for conveying the developer deposited on the sleeve 4 to the developing zone. Because the poles P2 and P6 are positioned relatively remote from the pole P1, magnetic lines of force issuing from the pole P1 extend at positions relatively remote from the surface of the sleeve 4, as shown in FIG. 1A. As shown in FIG. 1B, the developer deposited on the sleeve 4 and conveyed to the developing zone thereby rises along the magnetic lines of force in the form of brush chains, which constitute a magnet brush.

In Prior Art 2 shown in FIGS. 2A and 2B, the distance between the main magnetic pole P1*b* and each of the auxiliary magnetic poles P1*a* and P1*c* is smaller than the distance between the pole P1 and each of the poles P2 and P6 of Prior Art 1. Therefore, as shown in FIG. 28, magnetic lines of force issuing from the main pole P1*b* are positioned close to the surface of the sleeve 4, compared to the magnetic lines of force of Prior Art 1. In addition, many of the magnetic lines of force issuing from the main pole P1*b* extend toward the adjoining auxiliary poles P1*a* and P1*c*. It follows that the number of magnetic lines of force extending in directions close to the direction normal to the sleeve surface and contributing to the formation of the magnet brush (raising magnetic lines of force hereinafter) is smaller than in Prior Art 1. Also, the width over which the raising magnetic lines of force exist, as seen in the direction of movement of the sleeve surface, is narrower than in Prior Art 1.

For the above reasons, in Prior Art 2, the position where the developer reached the developing zone rises is closer to the center of the developing zone in the direction of movement of the sleeve surface than in Prior Art 1. This is also true with the position where the developer being conveyed via the developing zone falls. Consequently, the period of time over which the magnet brush on the sleeve 4 adjoins or contacts the drum 1 is shorter than in Prior Art 1. It follows that the period of time over which part of the magnet brush rubbing the trailing edge of the latent image, which is leaving the developing zone, has adjoined or contacted the non-image portion until then is reduced. This successfully decelerates the toner drift of the magnet brush that rubs the trailing edge portion of the latent image when leaving the developing zone and thereby reduces the omission of the trailing edge and enhances thin line reproducibility, compared to Prior Art 1.

In Prior Art 2, the auxiliary S poles P1*a* and P1*c* are positioned adjacent the main N pole P1*b*. Therefore, in the developing zone, the magnetic lines of force at a position spaced from the sleeve surface in the normal direction are more rough than in prior Art 1. In this condition, at the above position, e.g., the position where the tips of the brush chains exist, the flux density in the developing zone in the normal direction is lower in Prior Art 2 than in Prior Art 1. Consequently, in Prior Art 2, much of the toner forming the magnet brush are attracted toward the sleeve 4 where the flux density is high. As a result, as shown in FIG. 2B, the magnetic brush is shorter in Prior Art 2 than in Prior Art 1.

When the developing device of Prior Art 2 is actually used, the amount of the developer to be fed to the developing zone is selected to be smaller than the amount that can rise in the form of a magnet brush while being conveyed via the developing zone. More specifically, the amount of the developer to be fed is intentionally reduced to make the magnet brush short although it originally can be longer. In this condition, the tips of the brush chains are positioned in the region adjacent the surface of the sleeve 4 where the flux density is high, so that brush density is higher than in Prior Art 1. In addition, the minimum gap Pg for development between the sleeve 4 and the drum 1 decreases in accordance with the decrement of the brush length. The magnet brush can therefore rub the drum 1 with its portion adjacent the sleeve surface where the flux density is high, compared to Prior Art 1.

In Prior Art 2, the positions where the developer rises and falls are closer to the center of the developing zone than in Prior Art 1, as stated earlier. Therefore, as shown in FIG. 2B, in the developing zone, the width Pn over which the magnet brush rubs the drum 1, as seen in the direction of movement of the sleeve surface, is narrower than in Prior Art 1. Consequently, for given brush density, the amount of toner to be fed to the latent image on the drum 1 is smaller in Prior Art 2 than in Prior Art 1. However, Prior Art 2 can make brush density at the tips of the brush chains contacting the drum 1 higher than Prior Art 1 and can therefore prevent the toner to be fed to the latent image from decreasing.

It will be seen that although the width Pn of Prior Art 2 is narrower than the width of Prior Art 1, a sufficient amount of toner can be deposited on the latent image if, e g, the linear velocity ratio of the sleeve 4 to the drum 1 is increased.

The linear velocity ratio mentioned above may be increased by lowering the linear velocity of the drum 1 or raising the linear velocity of the sleeve 4, as stated earlier. However, when the linear velocity of the sleeve is raised, a centrifugal force acting on the developer deposited on the sleeve increases. As a result, carrier grains forming the magnetic brush are apt to part from the magnet brush due to, e.g., a shock to occur when the magnet brush contacts the image carrier, bringing about carrier scattering. Carrier scattering gives rise to various problems stated previously. This is particularly true with the medium-speed and high-speed image forming apparatuses stated earlier.

The two factors causative of carrier scattering mentioned earlier will be described in detail hereinafter. First, carrier scattering occurs via the opening of a casing included in the developing device. The sleeve 4 faces the drum 1 via the opening. Therefore, the opening should preferably be as small as possible. In practice, however, because the casing has substantial thickness and because the gap for development is small, the opening must be large enough to prevent its edges from contacting the drum 1. As a result, as shown in FIG. 3, Prior Art 2 is configured such that not only the portion of the sleeve 4 facing the main pole P1*b* but also the portions facing the auxiliary poles P1*a* and P1*b* are exposed to the outside via the opening.

Figure 3:
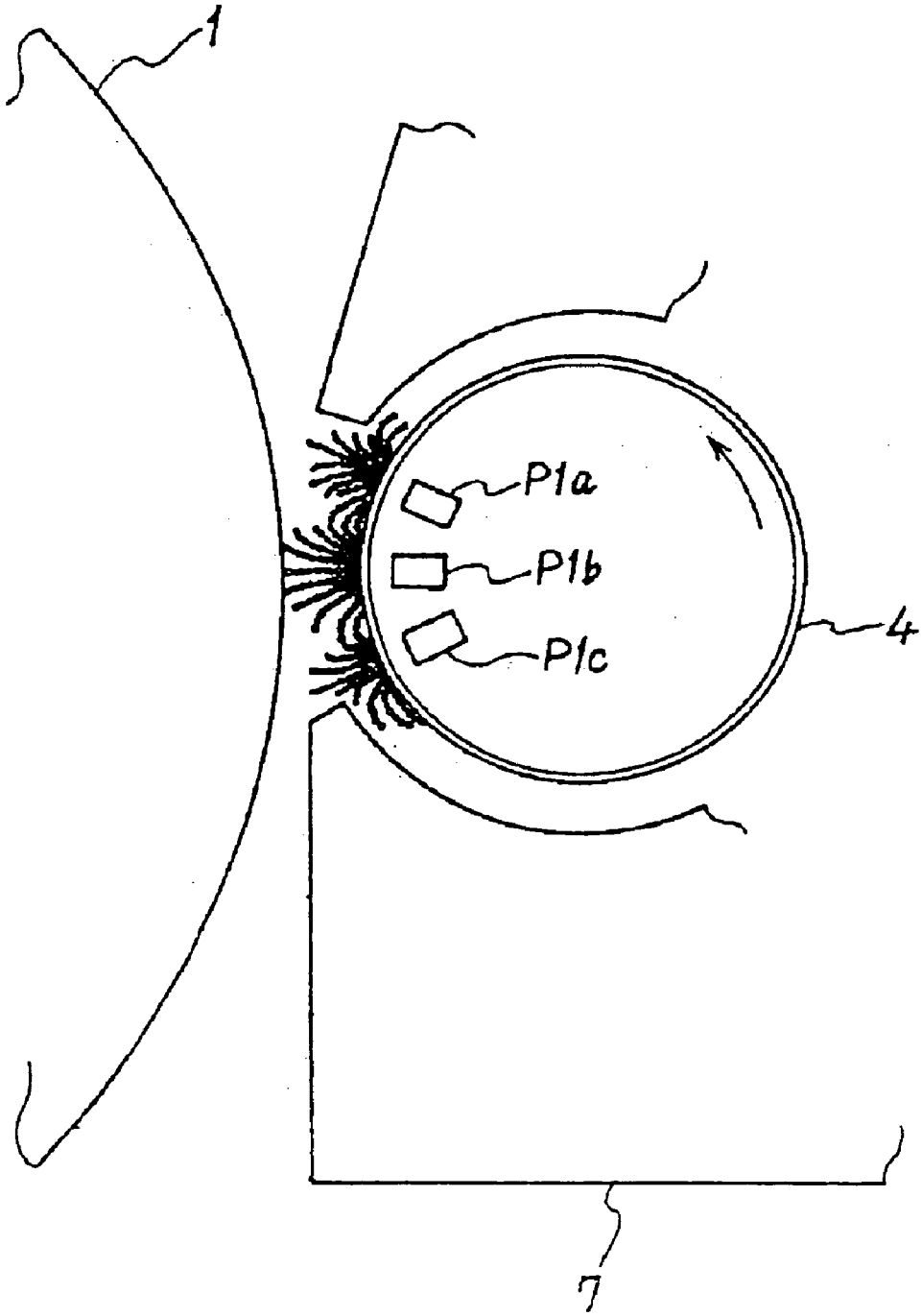
FIG. 3 PRIOR ART
FIG. 3 shows magnetic force distributions around the developing zone in the developing device of FIG. 2A.

As shown in FIG. 3, the developer rises along the magnetic lines of force of the auxiliary poles P1*a* and P1*c* in the same manner as it rises along the magnet lines of force of the main pole P1*b*. The carrier grains on the tips of the brush chains derived from the auxiliary poles P1*a* and P1*c* are subject to a stronger centrifugal force than the carrier grains of the flat developer. Further, part of the developer left the developing zone and lost toner grains is conveyed to the position of the auxiliary pole P1*c* downstream of the main pole P1*b*. As a result, the carrier grains lost toner grains again form the tips of the brush chains at the position of the auxiliary pole P1*c*. At this instant, toner grains deposited on the drum 1 and the background of the drum 1 opposite in polarity to the carrier grains exert an electrostatic force attracting the above carrier grains toward the drum 1. In this manner, the carrier grains on the tips of the brush chains formed by the auxiliary pole P1*c* are subject to the composite force of the strong centrifugal force and electrostatic force, tending to part from the magnet brush.

Second, the influence of gravity acting on the carrier grains differs from the brush chains formed by the auxiliary pole P1*a* to those formed by the auxiliary pole P1*c*, depending on the arrangement of the developing device relative to the drum 1. More specifically, one or both of the auxiliary poles P1*a* and P1*c* are sometimes positioned such that the normal lines at the points on the sleeve 4 where the flux densities are maximum are oriented downward in the vertical direction. In this case, the carriers on the tips of the brush chains formed by the auxiliary poles P1*a* and P1*c* are subject to the composite force of the strong centrifugal force and gravity, again tending to part from the magnet brush.

Preferred embodiments of the developing device and image forming apparatus in accordance with the present invention will be described hereinafter. In the illustrative embodiments, the image forming apparatus is implemented as a laser printer by way of example

First Embodiment

Figure 4:
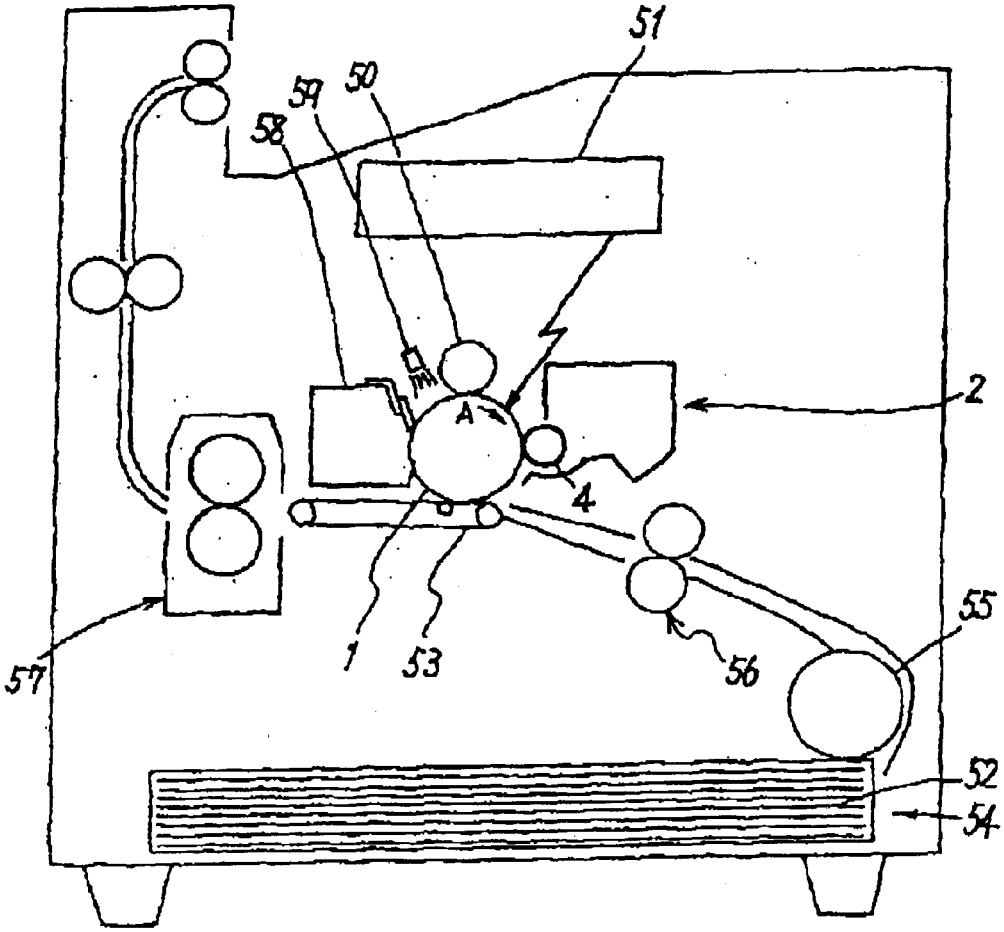
FIG. 4 shows the general construction of an image forming apparatus to which preferred embodiments of the present invention are applied.

A first embodiment of the present invention, which is mainly directed toward the first object stated earlier, will be described with reference to FIG. 4. As shown, the laser printer includes a photoconductive drum or image carrier 1 rotatable in a direction indicated by an arrow A. While the drum 1 is in rotation, a charge roller or charging means 50 uniformly charges the surface of the drum 1 in contact with the drum 1. Subsequently, an optical writing unit or latent image forming means 51 scans the charged surface of the drum 1 in accordance with image data to thereby form a latent image on the drum 1. The charge roller 50 and optical writing unit 51 may, of course, be replaced with any other suitable charging means and latent image forming means, respectively.

A developing device or developing means 2, which will be described specifically later, develops the latent image to thereby produce a corresponding toner image. An image transferring unit or image transferring means includes a belt 53 and transfers the toner image from the drum 1 to a sheet or recording medium 52, which is fed from a sheet cassette 54 by a pickup roller 55 via a registration roller pair 56. Subsequently, a fixing unit or fixing means 57 fixes the toner image on the sheet 52. The sheet or print 52 is then driven out of the printer.

After the image transfer, a cleaning unit or cleaning means 58 removes toner left on the drum 1. Further, a quenching lamp or discharging means 59 removes charge left on the cleaned surface of the drum 1.

Figure 5:
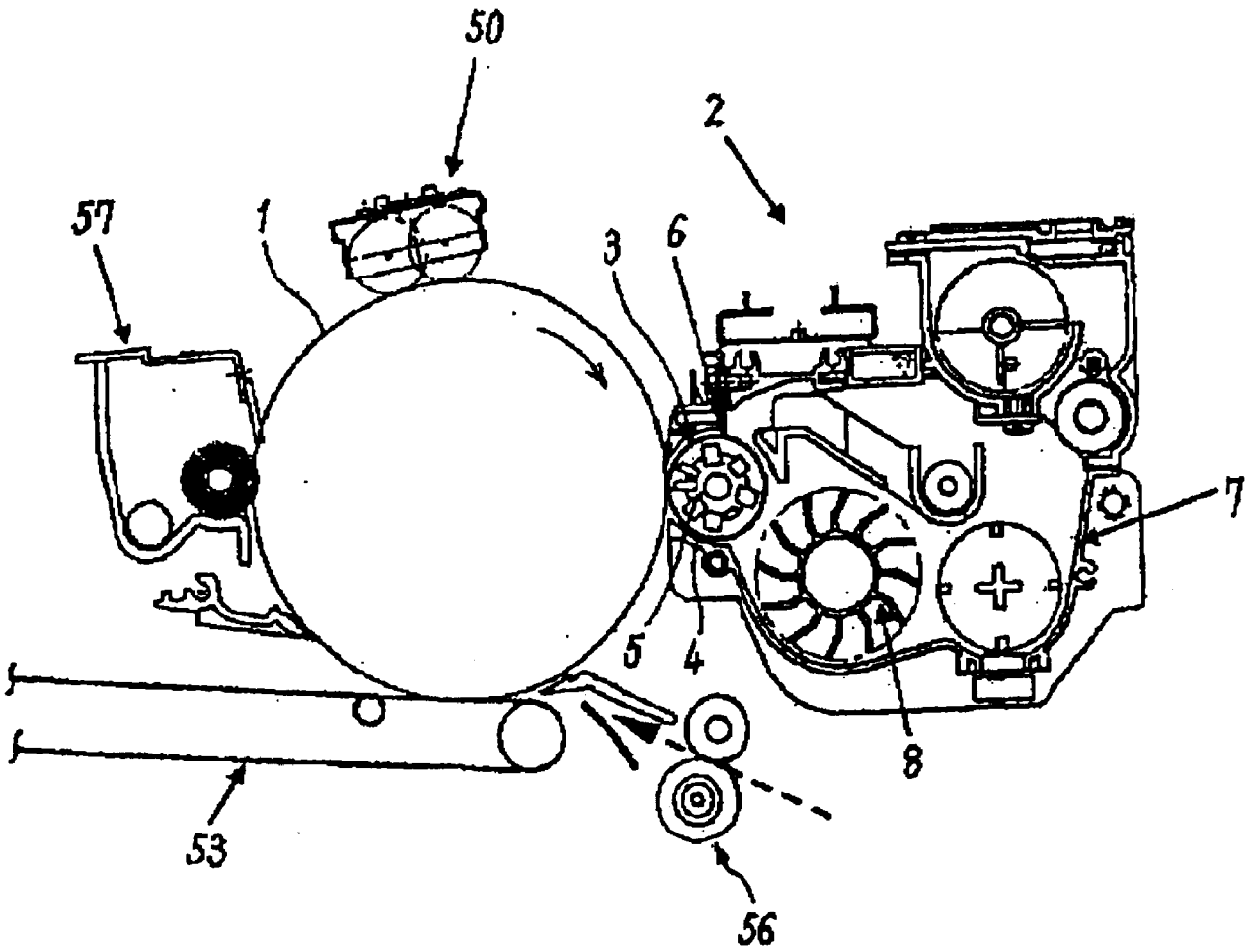
FIG. 5 shows a photoconductive drum included in the apparatus of FIG. 4 and arrangements around the drum.

FIG. 5 shows the developing device 2 specifically. As shown, the developing device 2 includes a developing roller or developer carrier 3 spaced from the drum 1 by a preselected gap for development. The developing roller 3 includes a sleeve 4 formed of aluminum, brass, stainless steel, conductive resin or similar nonmagnetic material. A stationary magnet roller or magnetic field forming means 5 is accommodated in the sleeve 4 for forming a magnetic field that causes a developer to form a magnet brush on the sleeve 4. Drive means, not shown, causes the sleeve 4 to rotate counterclockwise, as viewed in FIG. 5, around the magnet roller 5.

A doctor blade or metering member 6 is positioned upstream, in the direction of rotation of the sleeve 4, of a developing zone where the sleeve 4 and drum 1 face each other. The doctor blade 6 regulates the amount of the developer deposited on the sleeve 4. A so-called doctor gap between the doctor blade 6 and the sleeve 4 has influence on the amount of the developer to be conveyed to the developing zone. While the doctor gap is selected to be 0.48 mm in the illustrative embodiment, it is acceptable if lying in a range of from 0.35 mm and 0.5 mm. A screw 8 is disposed in a casing 7 at the side opposite to the drum 1 with respect to the developing roller 3 and scoops up the developer onto the sleeve 4 while agitating it.

In the illustrative embodiment, the drum 1 is provided with a diameter of 100 mm and caused to move at a linear velocity of 150 mm/sec, as measured in the developing zone. Also, the sleeve 4 is provided with a diameter of 25 mm and caused to move at a linear velocity of 300 mm/sec, as measured in the developing zone. The linear velocity ratio of the sleeve 4 to the drum 1 is therefore 2.0.

In the illustrative embodiment, the gap for development is selected to be 0.5 mm. A conventional gap for development is generally about ten times as great as the carrier grain size. For example, if the carrier grain size is 50 $\mu$m, then the gap is substantially between 0.65 mm and 0.8 mm. By contrast, a main magnetic pole included in the illustrative embodiment exerts a stronger magnetic force than conventional, so that the gap for development may even be about thirty times as great as the carrier grain size although such a gap is the upper limit as to image density.

Figure 6:
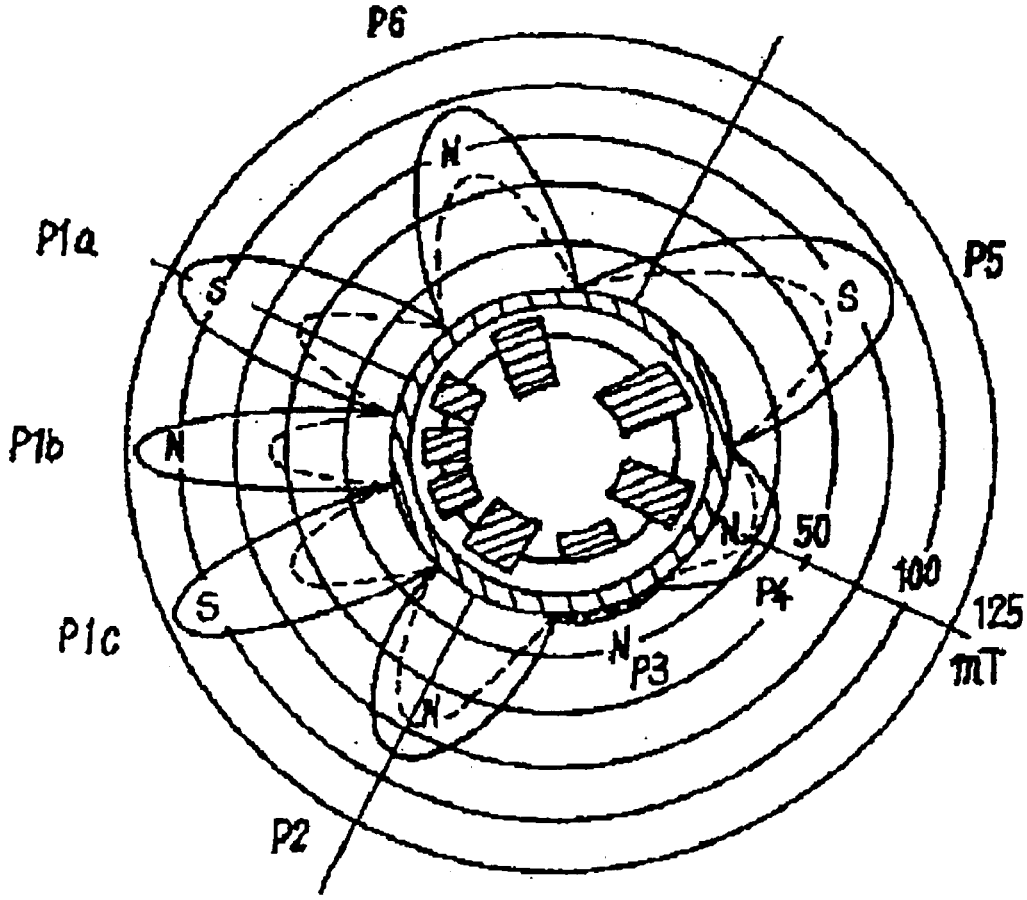
FIG. 6 is a circle chart showing the distributions of flux densities generated on a sleeve, which is included in the apparatus of FIG. 4, in the normal direction by the magnetic poles of a magnet roller.

FIG. 6 is a circle chart showing the distributions of flux densities established by the magnetic poles of the magnet roller 5 in the direction normal to the surface of the sleeve 4 (normal flux densities hereinafter). The circle chart was drawn by use of a gauss meter HGM-8300 and an axial probe Type A1 available from ADS. The magnetic fields formed by the magnet roller 5 cause carrier grains contained in the developer to rise on the sleeve 4 in the form of brush chains. Toner grains also contained in the developer electrostatically deposit on the brush chains, completing a magnet brush. The magnet brush is conveyed in the direction in which the surface of the sleeve 4 moves, i.e., counterclockwise as viewed in FIG. 5.

As shown in FIG. 6, in the illustrative embodiment, the magnet roller 5 has three magnetic poles P1*a*, P1*b* and P1*c* for forming a magnetic field that causes the developer to rise in the developing zone. The poles P1*a*, P1*b* and P1*c* are sequentially arranged in this order from the upstream side in the direction in which the surface of the sleeve 4 moves, and each is implemented as a magnet having a small sectional area.

Considering the fact that a magnetic force decreases with a decrease in the sectional area of a magnet, the poles P1*a* through P1*c* of the illustrative embodiments are implemented by magnets formed of a rare earth metal alloy, which exerts a relatively strong magnetic force. The maximum energy product available with a magnet formed of iron-neodymium-boron alloy, which is a typical rare earth metal alloy, is as great as 358 kJ/m$^3$. The maximum energy product available with an iron-neodymium-boron alloy bond is around 80 kJ/m$^3$. Generally, use is made of ferrite magnets or ferrite bond magnets whose maximum energy product is around 36 kJ/m$^3$ or around 20 kJ/m$^3$, respectively. Magnets formed of a rare earth metal alloy as in the illustrative embodiment can exert a stronger magnetic force that the above magnets even if their sectional area is small. In the illustrative embodiment, the normal flux densities of the three poles P1*a* through P1*c* formed on the sleeve 4 are selected to be 100 mT or above, but 200 mT or below.

In FIG. 6, dash-and-dot lines are representative of normal flux densities measured at positions spaced from the surface of the sleeve 4 by 1 mm in the normal direction. In the illustrative embodiment, the normal flux density has an attenuation ratio expressed as;

$$\text{attenuation ratio } (\%)=\{(X-Y)/X\}\times 100$$

where X denotes the peak value of the normal flux density on the sleeve surface, and Y denotes the peak value of the normal flux density at the position spaced from the sleeve surface by 1 mm. For example, if the normal flux density on the sleeve surface is 100 mT and if the normal flux density at the 1 mm spaced position is 80 mT, then the attenuation ratio of the flux density is 20%.

Figure 7:
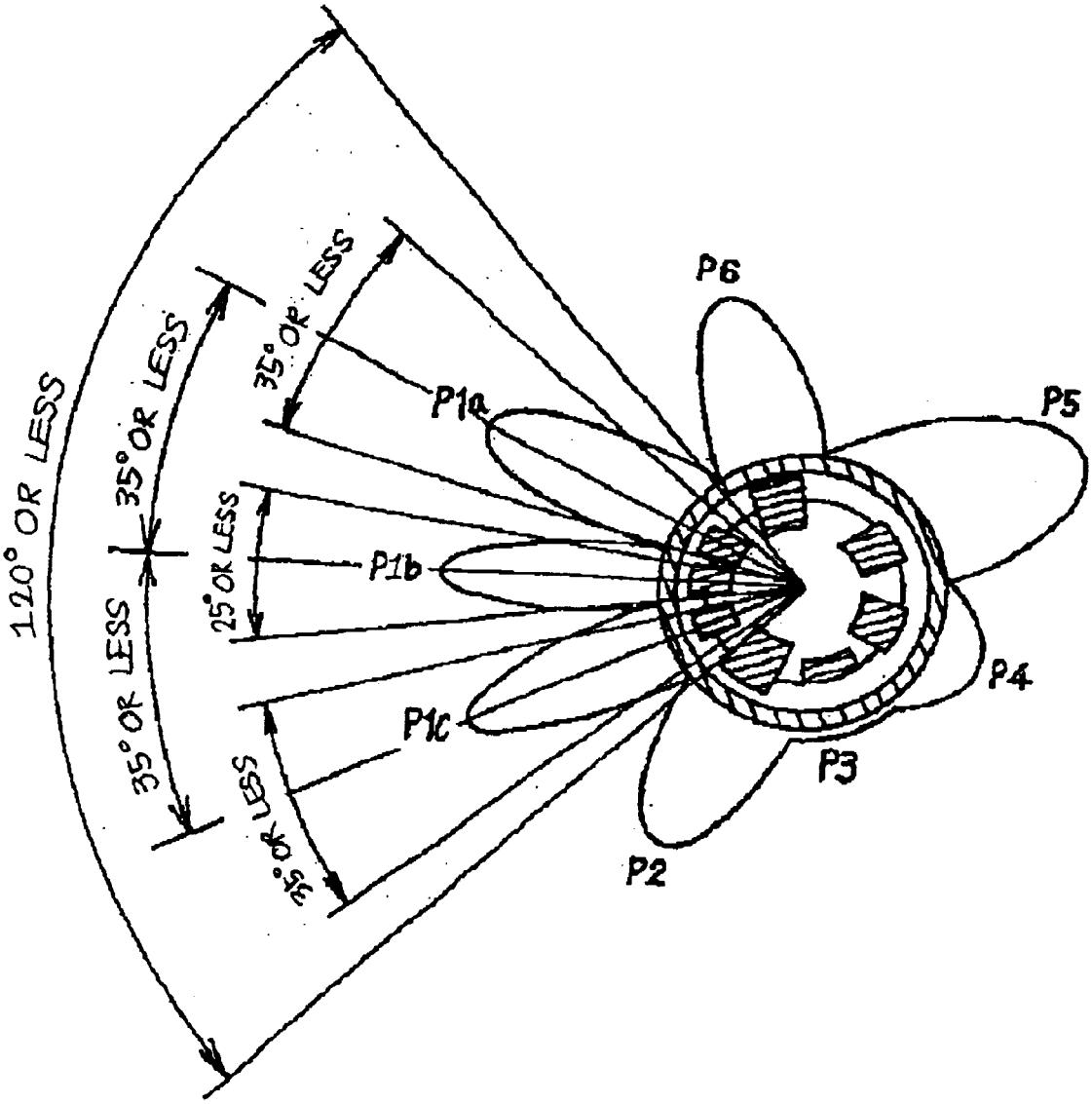
FIG. 7 shows the arrangement of three of the magnetic poles shown in FIG. 6 that constitute a magnetic pole for development.

FIG. 7 shows the arrangement of the magnetic poles of the magnet roller 5. As shown, among the three magnetic poles P1*a* through P1*b* contributing to development, the pole P1*b* mainly causes the developer to rise in the developing zone while the auxiliary poles P1*a* and P1*c* are opposite in polarity to the main pole P1*b*. The auxiliary poles P1*a* and P1*c* are respectively positioned upstream and downstream of the main pole P1*b* in the direction in which the surface of the sleeve 4 moves. A pole P4 scoops up the developer onto the sleeve 4 while a pole P6 conveys the developer deposited on the sleeve 4 to the developing zone. Poles P2 and P3 are positioned downstream of the developing zone in the above direction for conveying the developer. Further, a pole P5 also serves to convey the developer deposited on the sleeve 4. In the illustrative embodiment, the poles P1*b*, P4, P6, P2 and P3 are N poles while the poles P1*a*, P1*c* and P5 are S poles.

In the illustrative embodiment, the main pole P1*b* is implemented by a magnet whose normal flux density on the sleeve 4 has the maximum value of about 120 mT. In this condition, if the auxiliary poles P1*c* and P1*b* each have normal flux density of 100 mT or above, then defective images ascribable to carrier deposition on the drum 1 and other causes are obviated by use of carrier grains having a saturation magnetization value to be described later, as determined by experiments. Carrier deposition on the drum 1 is more likely to occur as a tangential magnetic force on the sleeve 4 in the developing zone becomes weaker. In this respect, it is important to increase the tangential magnetic force. However, carrier deposition can be sufficiently coped with if the magnetic force of either one of the main pole P1*b* and auxiliary pole P1*c* is sufficiently increased.

The auxiliary poles P1*a* and P1*c* are used to adjust the normal flux density distribution of the main pole P1*c* on the surface of the sleeve 4. More specifically, the auxiliary poles P1*a* and P1*c* serve to narrow an angular width between half-value points (half-value angular width hereinafter) in the direction of movement of the sleeve surface in the developing zone, as seen from the curvature axis of the sleeve surface, i.e., the axis of the sleeve 4. The half-value angular width refers to an angular width, as seen from the axis of the sleeve 4, between two half-value points on the sleeve surface where the flux density is one-half of the peak value of the normal flux density generated by the main pole P1*c* on the sleeve surface. For example, when the peak value of the normal flux density is 120 mT, then the half-value angular width is the angle between two half-value points on the sleeve surface where the normal flux density is 60 mT.

In the illustrative embodiment, the magnetic characteristic and positions of the auxiliary poles P1*a* and P1*c* are selected such that the half-value angular width of the main pole P1*b* is 25° or less. More specifically, the magnets implementing the poles P1*a*, P1*b* and P1*c* each are provided with a sectional area, as seen in the direction of movement of the sleeve surface, having a width of 2 mm. Consequently, in the illustrative embodiment, the half-value angular width of the main pole P1*b* is 16°.

Figure 8A:
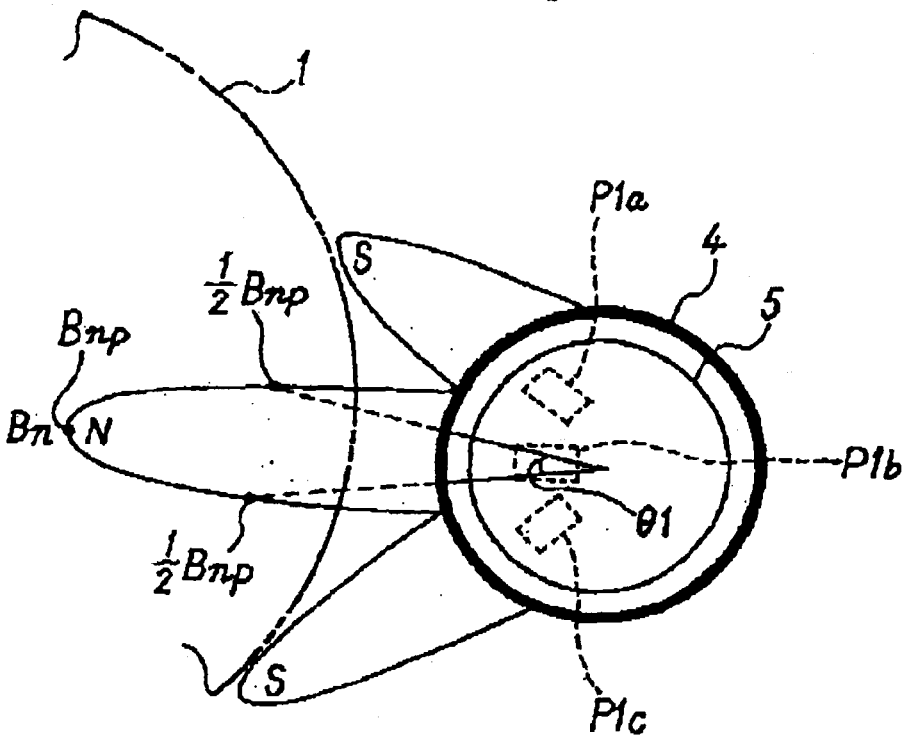
FIG. 8A is a view for describing a half-value angular width established when three magnetic poles constitute a pole for development.
Figure 8B:
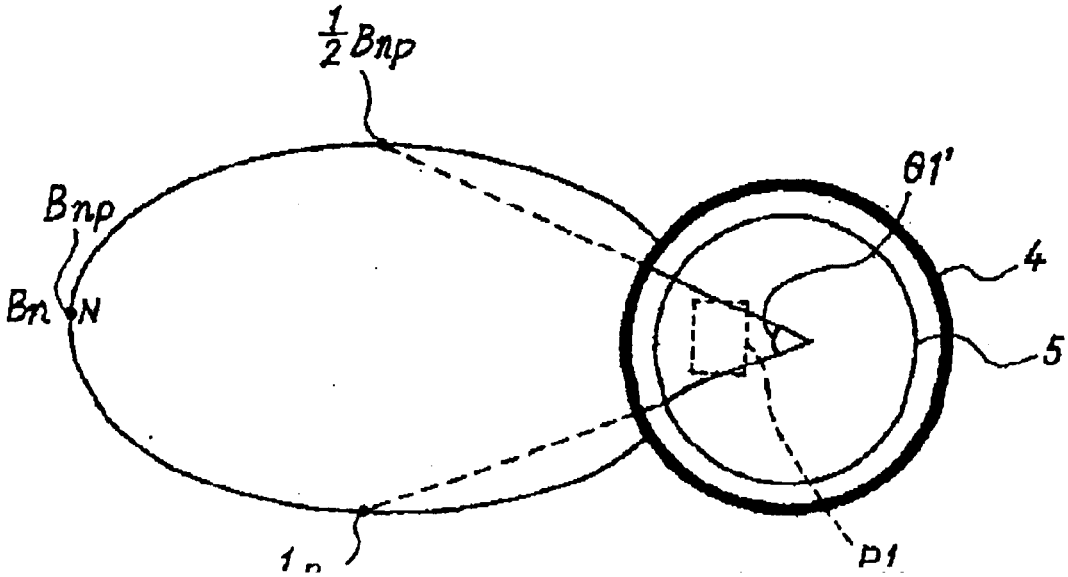
FIG. 8B is a view for describing a half-value angular width established when a single magnetic pole constitutes a pole for development.

FIGS. 8A and 8B compare the pole arrangement of the illustrative embodiment shown in FIG. 6 and the conventional pole arrangement with respect to the half-value angular width. As shown, the main pole P1*b* of the illustrative embodiment has a half-value angular width θ1 narrower than the half-value angular width θ1' available with the conventional single pole P1 for development. It was experimentally found that when the half-value angular width of the main pole P1*b* exceeded 25°, image defects including the omission of the trailing edge of an image occurred.

As shown in FIG. 7, in the illustrative embodiment, the half-value angular width of each of the auxiliary poles P1*a* and P1*c* is selected to be 35° or less. Also, as shown in FIG. 7, the angular width between the main pole P1*b* and each of the auxiliary poles P1*a* and P1*c* is selected to be 30° or less. This angular width refers to an angle, in the direction of movement of sleeve surface, between points on the sleeve surface where the normal flux density of the main pole P1*b* and that of the auxiliary pole P1*a* or P1*c* have peak values, as seen from the axis of the sleeve 4. In the illustrative embodiment, the angular width between the main pole P1*a* and the auxiliary pole P1*a* or P1*c* is selected to be 25° because the half-width angular width of the main pole P1 is 16°, as stated earlier.

Further, in the illustrative embodiment, the angular width between, among polarity transition points where the normal flux densities generated by the poles P1*a* through P1*c* on the sleeve surface are 0 mT, two polarity transition points positioned at the most upstream side and most downstream side in the direction of movement of the sleeve surface is 120° or less. More specifically, as shown in FIG. 7, the angular width between the transition point between the poles P1*a* and P6 and the transition point between the poles P1*c* and P2 is selected to be 120° or less.

In the conditions described above, the magnetic characteristics of the poles P1*a* through P1*c* were measured, as will be described hereinafter. The normal flux density of the main pole P1*b* had a peak value of 120 mT on the surface of the sleeve 4. The normal flux density at a position spaced from the sleeve 4 by 1 mm was 55.8 mT. The normal flux density therefore varied by 64.2 mT, i.e., the attenuation ratio was 53.5%.

The normal flux density of the auxiliary pole P1*a* upstream of the main pole P1*b* had a peak value of 100 mT on the surface of the sleeve 4. The normal flux density at a position spaced from the sleeve 4 by 1 mm was 53.3 mT. The normal flux density therefore varied by 46.7 mT, i.e., the attenuation ratio was 46.7%.

Further, The normal flux density of the auxiliary pole P1*c* downstream of the main pole P1*b* had a peak value of 120 mT on the surface of the sleeve 4. The normal flux density at a position spaced from the sleeve 4 by 1 mm was 64.7 mT. The normal flux density therefore varied by 526 mT, i.e., the attenuation ratio was 43.8%.

In the conventional magnet roller 5 shown in FIG. 5B, the normal flux density of the pole P1 had a peak value of 90 mT on the surface of the sleeve 4. The normal flux density at a position spaced from the sleeve 4 by 1 mm was 63.9 MT. The normal flux density therefore varied by 26.1 mT, i.e., the attenuation ratio is 29%.

The developer rises along the magnetic lines of force issuing from the magnet roller 5, which has the magnetic poles P1 through P1*c*, forming a magnet brush on the sleeve 4. Only part of the magnet brush formed by the magnetic field of the main pole P1*b* contacts the surface of the drum 1 for developing a latent image. The length of the magnet brush in the developing zone is selected to be about 1 mm. It is to be noted that the length of the magnet brush is measured with the drum 1 being dismounted; in practice, because the gap for development is 0.5 mm, the length decreases in accordance with the gap.

Why the length of the magnet brush can be so reduced is that the normal flux density has the great attenuation ratio stated earlier. More specifically, although the normal flux density on the surface of the sleeve 4 is high, the attenuation ratio is also high, and therefore the normal flux density at the position spaced from the sleeve surface by 1 mm sharply decreases. As a result, although the developer densely gathers around the sleeve surface due to the strong magnetic field, it cannot maintain the brush chains at a position relatively remote from the sleeve surface due to the weak electric field.

In the illustrative embodiment, the doctor gap is suitably adjusted such that the developer is conveyed, or fed, to the developing zone by the sleeve 4 in a slightly small amount between 65 mg/cm$^2$ and 95 mg/cm$^2$. Consequently, the length of the magnet brush is reduced due to short developer despite that a grater length could be achieved. In the gap of 0.5 mm for development, the magnet brush with such a limited length densely gathers around the surface of the sleeve 4 where the flux density is high, rubbing the surface of the drum 1.

While the gap for development is selected to be 0.5 mm in the illustrative embodiment, it is acceptable if lying in a range of 0.3 mm and 0.5 mm. This range allows the brush portion densely gathering around the surface of the sleeve 4 to rub the surface of the drum 1.

In the configuration described above, the width of the developing zone in the direction of movement of the sleeve surface over which the magnet brush formed by the main pole P1*b* contacts the drum 1 lies in a relatively narrow range, i.e., between the carrier grain size and 2 mm. This insures images free from the omission of a trailing edge and with faithfully reproduced thin lines and solitary dots.

Carrier grains applicable to the illustrative embodiment will be described hereinafter. Carrier grains have cores formed of any conventional magnetic material, e.g., iron, cobalt, nickel or similar ferromagnetic metal or magnetite, hematite, ferrite or similar alloy or compound.

The magnetic characteristic of the carrier grains effects the influence of the magnetic fields of the magnet roller 5 on the carrier grains and has therefore critical influence on the developing characteristic and conveyance of the developer, as determined by experiments to be described later. In the illustrative embodiment, use is made of carrier grains whose saturation magnetization value is $40\times10^{-7}\times4\ \pi$Wb·m/kg or above, but below $60\times10^{-7}\times4\ \pi$Wb·m/kg. The saturation magnetization value refers to the intensity of magnetization measured in a magnetic field of $3000\times10^{3}/4\pi$ A/m.

In the illustrative embodiment, the carrier grains each have a grain size ranging from 20 $\mu$m to 100 $\mu$m, preferably from 20 $\mu$m to 80 $\mu$m. The carrier grains with such a grain size can increase the toner content of the developer and allows, attractive images to be formed even when the illustrative embodiment is applied to the previously mentioned image forming apparatus with high image forming speed in which an image carrier moves at high linear velocity.

Considering the magnetic characteristic of the carrier grains stated above, it is preferable to use ferrite as the cores of the carrier grains.

Resin that coats the carrier grains may be implemented by thermosetting silicone resin customarily used. In the illustrative embodiment, fine grains are added to the coating resin in order to control the resistance of the carrier grains such that static resistance is between 12 log Ω and 14 log Ω. The fine grains should preferably have a grain size ranging from 0.01 μm to 5.0 μm.

A coupling agent, particularly a silane coupling agent, may be used to adjust the chargeability of the carrier grains or to enhance adhesion between the coating resin and the cores. The coupling agent may be any one of γ-(2-aminoethyl)aminopropyl trimethoxysilane, γ-(2-aminoethyl)aminopropyl methyldimethoxysilane, γ-methacryloxypropyl trimethoxysilane, γ-glycidoxypropyl trimethoxysilane, γ-mercaptopropyl trimethoxysilane, methyltrimthoxysilane, methyltriethoxysilane, vinyltriacetoxysilane, γ-chloropropyl methoxysilane, γ-anilinopropyl trimethoxysilane, vinyltrimethoxysilane, octadecyldimethyl[3-(trimethoxysilyl)propyl]ammonium chloride, γ-chloropropylmethyl dimethoxysilane, methyltrichlorosilane, dimethyldichlorosilane and methyldichlorosilane available from TORAY SILICONE, and aryltriethoxysilane, 3-aminopropylmethyldiethoxysilane, 3-amonopropyltrimethoxysilane, dimethyldiethoxysilane and methacryloxyethyldimethyl (3-trimethoxysilylpropyl) ammonium chloride available from CHISSO.

The toner grains applicable to the illustrative embodiment may be produced by any one of conventional technologies. For example, a binder resin, a colorant and a polarity control agent may be mixed together, kneaded by a thermal roll mill, cooled off, pulverized, and then classified. Any suitable additive may be added to the toner grains.

In the illustrative embodiment, the weight-mean grain size of the toner grains is selected to be between 6 μm and 10 μm. To measure the weight-mean grain size, use may be made of a counter available from COULTER, e.g., COULTER Counter type II. The weight-mean grain size can be determined if the result of counting is analyzed as to, e.g., a number distribution and a volume distribution. As for an electrolyte for the measurement, use may be made of 1% aqueous solution of sodium chloride using primary sodium chloride.

The binder resin for the toner grains may be any one of binder resins customarily applied to toners and including, e.g., a monomer of polystyrene, polychlorostyrene, polyvinyl toluene or similar styrene or a substitution thereof, styrene/p-chlorostyrene copolymer, styrene/propylene copolymer, styrene/vinyltoluene copolymer, styrene/vinylnaphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene, ethyl methacrylate copolymer, styrene/butyl methacrylate copolymer, styrene/α-methyl chloromethacrylate, styrene/acrylonitrile copolymer, styrene/vinylmethyl ether copolymer, styrene/vinylethyl ether copolymer, styrene/vinylmethylketone copolymer, styrene/butadien copolymer, styrene/isoprene copolymer, styrene/acrylonitrile/indene copolymer, styrene/maleic acid copolymer, styrene/maleic acid ester or similar styrene copolymer, poly(methyl methacrylate), poly(butyl methacrylate), polyvinyl chloride, polyvinyl acetate, polyethylene, polypropylene, polyester, polyvinyl butyral, polyacrylic resin, rosin, modified rosin, terpene resin, phenol resin, chlorinated paraffin, or paraffin wax. Two or more of such binder resins may be combined.

The colorant may be implemented by any one of conventional colorants applied to toners. Colorants for black include carbon black, Aniline Black, furnace black, and lamp black. Colorants for cyan include Phthalocyanine Blue, Methylene Blue, Victoria Blue, Methyl Violet, Aniline Blue, and Ultramarine Blue. Colorants for magenta include Rhodamine 6G Lake, dimethyl quinacrydone, Watching Red, Rose Bengal, Rhodamine B, and Arizarine Lake. Colorants for yellow include Chrome Yellow, Bendizine Yellow, Hansa Yellow, Naphtole yellow, and Molybdenum Yellow, Quinoline Yellow.

If desired, a small amount of charge depositing agent, e.g., dye or pigment, and a small amount of charge control agent may be added in order to promote efficient charging of the toner grains.

Other additives applicable to the toner grains include fine grains of silica or titanium oxide. In the illustrative embodiment, use is made of fine grains of, e.g., silica or titanium oxide processed by a silicone oil processing agent. The silicone oil processing agent should preferably contain one or more of modified silicone oil, hydrogen oil or fluorine-containing silicone oil having a reactive radical in a molecule. Alternatively, use may be made of modified silicone oil not containing such an active radical in a molecule. As for modified silicone oil containing a reactive radical in a molecule, it is preferable to use one or more of modified silicones containing one or more of radicals selected from a group including a hydroxy group, a carboxyl group, an amino group, an epoxy group, an ether group, and a mercapto group. The silicone oil should preferably have viscosity of 5 cp or above, but 15,000 cp or below, at room temperature. The silicone oil processing agent reduced the wear of the drum 1 ascribable to the silica grains.

When use is made of toner grains with a small grain size as in the illustrative embodiment, excessive charging ascribable to friction is apt to occur and increase the amount of charge in a repeat print mode. As a result, the toner grains are likely to depot on the non-image portion of the drum 1 due to counter-charge. To control the amount of charge to deposit on the toner grains, in the illustrative embodiment, fine grains of titanium oxide are added to the toner grains. The amount of titanium oxide grains to be added should preferably such that the specific surface area of titanium oxide with respect to the total surface area of the toner grain, as measured by nitrogen absorption available with a BET method, is 30 $m^2/g$ or above, preferably between 50 $m^2/g$ and 400 $m^2/g$. However, if the titanium oxide grains are added more than the silica grains, then the amount of charge to deposit on the toner grains becomes short. In light of this, the ratio of the titanium oxide grains to the silica oxide grains should preferably be 0.6 or below. Also, the total amount of such fine grains to be added to the toner grains should preferably be between 0.5 wt % and 2 wt %.

Four different experiments conducted with the laser printer described above will be described hereinafter. First, the compositions and the producing methods of toner T and carriers C1 through C8 used for the experiments will be described.

(Production of Toner T)

A mixture of substances listed in FIG. 9 were sufficiently mixed in a Henschel mixture, then melted in a roll mill at 80° C. for about 30 minutes, and then cooled to room temperature. The resulting kneaded mixture was classified by a jet mill to thereby prepare classified toner grains having a grain size of 6.5 μm and containing fine grains of 4 μm and below by 60% or below. 1.0 part of fine silica grains and 0.4 part of fine titania grains are added to 100 parts of the classified toner grains and then mixed together in a Henschel mixer, which was rotated at a speed of 1,500 rpm, to thereby produce toner grains T. The toner grains T had a weight-mean grain size of 6.7 μm.

(Production of Carrier C1)

Substances listed in FIG. 10 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.4 MPa, thereby forming coating layers on the ferrite grains. Subsequently, the ferrite grains were baked in an electronic furnace at 300° C. for 2 hours to thereby produce carrier grains C1. The ferrite grains had a mean grain size of 55 μm, a saturation magnetization value of $25\times10^{-7}\times4$ Wb·m/kg, a current value of 22 μA, and a fluidity of 25 sec/50 g. The current value refers to one that flows when a magnet brush contacts the drum 1. This is also true with the other current values to appear later. The carrier grains C1 had a static resistance of 16.2 log Ω, a fluidity of 29 sec/50 g, and a saturation magnetization value of $25\times10^{-7}\times4$ πWb·m/kg. The carrier C1 thus produced is conventional.

(Production of Carrier C2)

Substances listed in FIG. 11 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.4 MPa, thereby forming coating layers on the ferrite grains. Subsequently, the ferrite grains were baked in an electronic furnace at 300° C. for 2 hours to thereby produce carrier grains C2. The ferrite grains had a mean grain size of 55 μm and a saturation magnetization value of $40\times10^{-7}\times4$ πWb·m/kg. The carrier grains C2 had a mean grain size of 55 μm and a saturation magnetization value of $40\times10^{-7}\times4$ πWb·m/kg.

(Production of Carrier C3)

Substances listed in FIG. 11 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.4 MPa, thereby forming coating layers on the ferrite grains. Subsequently, the ferrite grains were baked in an electronic furnace at 300° C. for 2 hours to thereby produce carrier grains C3. The ferrite grains had a mean grain size of 55 μm and a saturation magnetization value of $60\times10^{-7}\times4$ πWb·m/kg. The carrier grains C3 had a mean grain size of 55 μm and a saturation magnetization value of $60\times10^{-7}\times4$ πWb·m/kg.

(Production of Carrier C4)

The substances listed in FIG. 10 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.4 MPa, thereby forming coating layers on the ferrite grains. Subsequently, the ferrite grains were baked in an electronic furnace at 300° C. for 2 hours to thereby produce carrier grains C4. The ferrite grains had a mean grain size of 55 μm, a saturation magnetization value of $50\times10^{-7}\times4$ πWb·m/kg, a current value of 60 μA, and a fluidity of 25 sec/50 g. The carrier grains C4 had a static resistance of 12.4 log Ω, a fluidity of 29 sec/50 g, and a saturation magnetization value of $50\times10^{-7}\times4$ πWb·m/kg.

(Production of Carrier C5)

Substances listed in FIG. 12 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.4 MPa, thereby forming coating layers on the ferrite grains. Subsequently, the ferrite grains were baked in an electronic furnace at 300° C. for 2 hours to thereby produce carrier grains C5. The ferrite grains had a mean grain size of 55 μm, a saturation magnetization value of $50\times10^{-7}\times4$ πWb·m/kg, and a current value of 30 μA. The carrier grains C5 had a static resistance of 13.8 log Ω, a fluidity of 35 sec/50 g, and a saturation magnetization value of $50\times10^{-7}\times4$ πWb·m/kg.

(Production of Carrier C6)

The substances listed in FIG. 11 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.4 MPa, thereby forming coating layers on the ferrite grains. Subsequently, the ferrite grains were baked in an electronic furnace at 300° C. for 2 hours to thereby produce carrier grains C7. The ferrite grains had a mean grain size of 55 μm, a saturation magnetization value of $50\times10^{-7}\times4$ πWb·m/kg, a current value of 30 μA, and a fluidity of 30 sec/50 g. The carrier grains C7 had a static resistance of 13.8 log Ω, a fluidity of 42 sec/50 g, and a saturation magnetization value of $50\times10^{-7}\times4$ πWb·m/kg.

(Production of Carrier C8)

The substances listed in FIG. 11 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.3 MPa, thereby forming coating layers on the ferrite grains. Subsequently, the ferrite grains were baked in an electronic furnace at 340° C. for 2 hours to thereby produce carrier grains C8. The ferrite grains had a mean grain size of 55 μm, a saturation magnetization value of $50\times10^{-7}\times4$ πWb·m/kg, a current value of 30 μA, and a fluidity of 25 sec/50 g. The carrier grains C8 had a static resistance of 13.8 log Ω, a fluidity of 33 sec/50 g, and a saturation magnetization value of $50\times10^{-7}4$ πWb·m/kg.

(Production of Carrier 9)

The substances listed in FIG. 11 were dispersed in a homomixer for 20 minutes to thereby prepare a coating liquid. The coating liquid was sprayed on the surfaces of 1,000 parts of ferrite grains by a fluid bed coating apparatus at a spray air pressure of 0.3 MPa, thereby forming coating layers on the ferrite grains. Subsequently, the ferrite grains were baked in an electronic furnace at 340° C. for 2 hours to thereby produce carrier grains C9. The ferrite grains had a mean grain size of 55 μm, a saturation magnetization value of $50\times10^{-7}\times4$ πWb·m/kg, a current value of 30 μA, and a fluidity of 25 sec/50 g. The carrier grains C9 had a static resistance of 13.8 log Ω, a fluidity of 33 sec/50 g, and a saturation magnetization value of $50\times10^{-7}4$ πWb·m/kg.

(Measuring Method)

A method used to measure the characteristics of toner and those of carrier will be described hereinafter. To measure the saturation magnetization value of carrier grains, use was made of a measuring device BHU-60 available from RIKEN SOKUTEI CO., LTD. About 1.0 g of carrier grains were packed in a cell having a diameter of 7 mm and a height of 10 mm and then set on the measuring device. Subsequently, the magnetic field applied to the cell was raised little by little up to $3{,}000\times10^3/4\pi$ A/m and then lowered. The resulting hysteresis curve was recorded on a paper. A saturation magnetization value determined on the basis of the recorded result was used as the saturation magnetization value of carrier grains.

As for the mean grain size of carrier grains, use was made of a microtrack grain analyzer Type 7995 produced by LEEDS & NORTHRUP and available from NIKKISO CO., LTD. Measurement was effected in the range of from 0.7 μm and 125 μm.

Fluidity mentioned in relation to the carrier and developer refers to a period of time necessary for 50 g of carrier grains or developer to drop via pores. Measurement was effected after a sample had been left at a temperature of 23±3° C. and a humidity of 60±10% for 2 hours in accordance with JIS (Japanese Industrial Standards) Z2504.

Figure 13:
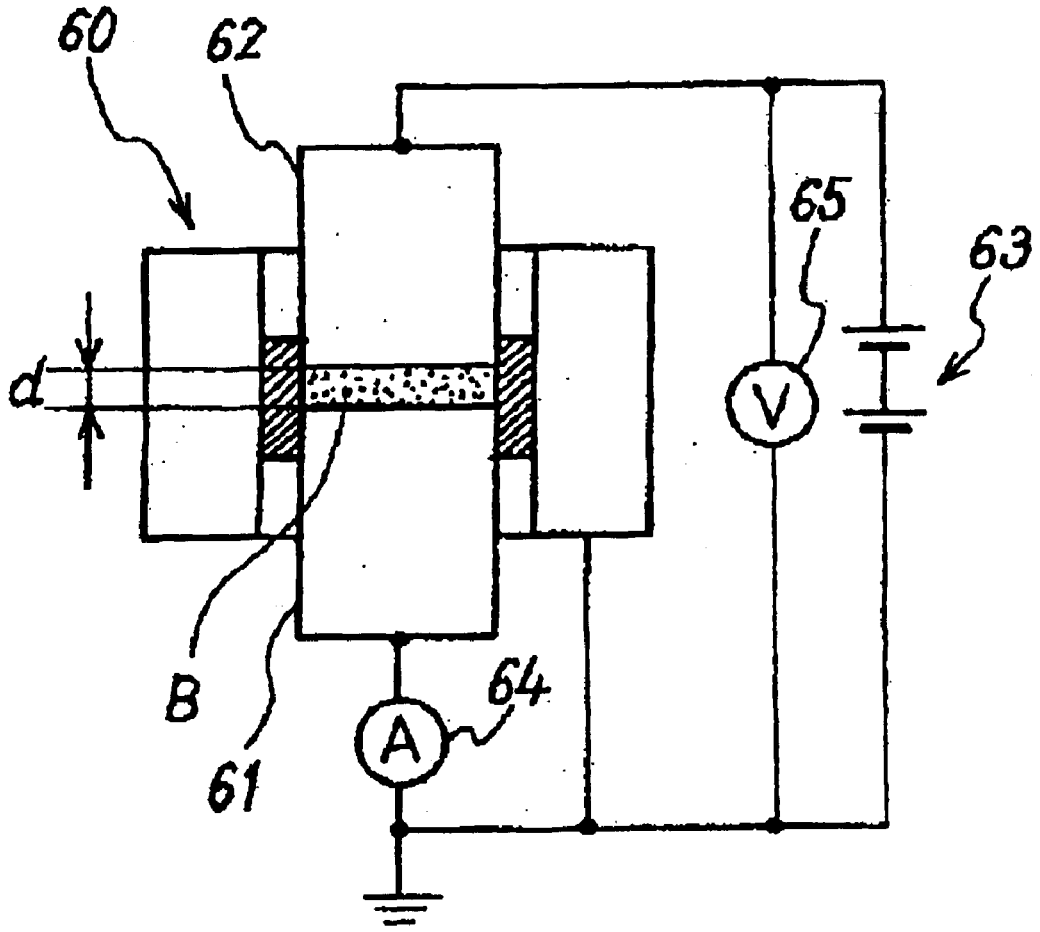
FIG. 13 shows a specific arrangement for measuring the static resistance of a carrier.

FIG. 13 shows a specific device for measuring the static resistance of carrier. As shown, the measuring device includes a cell 60, two electrodes 61 and 62 connected to the cell 60, a power supply 63 for applying a voltage between the electrodes 61 and 62, an ammeter 64 for measuring a current to flow between the electrodes 61 and 62, and a voltmeter 65 for measuring a voltage between the electrodes 61 and 62.

For measurement, a carrier or a developer B was packed in the cell 60 In this condition, the static resistance of the carrier or developer B was determined on the basis of a current measured by the ammeter 64 when a voltage applied from the power supply 63. The electrodes 61 and 62 each contacted the carrier or developer B over an area of about 4.0 $cm^2$. The distance between the electrodes 61 and 62, i.e., the thickness d of the carrier or developer B in the direction of current was about 2 mm. The voltage applied from the power supply 63 was 500 V. In this case, care should be taken because the carrier or developer B, which is powder, is apt to cause the packing ratio of the cell 60 and therefore static resistance to vary.

As for the weight-mean grain size of toner, use was made of COULTER Counter Type II available from COULTER. The result of measurement was used to execute analysis as to, e.g., a number distribution and a volume distribution to thereby determine a weight-mean grain size. An electrolyte for the measurement was implemented by a 1% aqueous solution of sodium chloride adjusted by use of primary sodium chloride.

[Experiment 1]

In the developing device 2 used in Experiment 1 to be described, the attenuation ratio of the normal flux density is 40% or above while the amount of developer fed is between 65 mg/$cm^2$ and 95 mg/$cm^2$, so that the magnet brush is short and dense, as stated earlier. It is therefore necessary to cause the sleeve 4 to move at a linear velocity 1.1 times to 3.0 times, in practice about 1.5 times to about 2.0 times, higher than the linear velocity of the drum 1, as measured at the developing zone, thereby maintaining high image quality. However, an increase in the linear velocity of the sleeve 4 brings about the carrier deposition problem. In light of this, Experiment 1 was conducted to determine a relation between the saturation magnetization value of the carrier and the carrier deposition on the drum 1.

In Experiment 1, the toner T and each of the carriers C1 through C3 were mixed to prepare two developers having a toner content of 5 wt % each. In the developing device 2 used in Experiment 1, the normal flux density of the main pole P1*b* has a peak value of 120 mT, an attenuation ratio of 53%, and a half-value angle of 16°. In Experiment 1, the ratio of the linear velocity of the sleeve 4 (300 mm/sec) to that of the drum 1 (150 mm/sec) is selected to be 2.0. 1 kg of each of the above developers was set in the developing device 2 and used to output half-tone images over the entire surfaces of ten sheets of size A4 (landscape) When carrier grains deposit on the drum 1, a halftone image is partly lost in the form of white spots. In Experiment, such white spots appeared in the ten prints were counted, and a mean number of white spots was used for estimation as a characteristic value. If the number of white spots for a single print is fifteen or less, the carrier deposition lies in an allowable level in practical use.

FIG. 14 lists the results of Experiment 1. As shown, when the developer containing the carrier C1 whose saturation magnetization value was $25\times10^{-7}\times4$ πWb·m/kg was used, thirty-eight point three dots appeared for a single print. By contrast, the developers containing the carriers C2 and C3 whose saturation magnetization values were $40\times10^{-7}\times4$ πWb·m/kg and $60\times10^{-7}4$ πWb·m/kg, respectively, derived fourteen point nine white spots and ten point six white spots, respectively. It was therefore determined that when the saturation magnetization value of the carrier was $40\times10^{-7}\times4$ πWb·m/kg or above, but below $60\times10^{-7}\times4$ πWb·m/kg, carrier deposition on the drum 1 was less conspicuous than when the saturation magnetization value was less than $40\times10^{-7}\times4$ πWb·m/kg. This will be described more specifically hereinafter.

The attenuation ratio is as high as 53.5% in the illustrative embodiment. Therefore, a magnetic restraining force urging the carrier grains, which are positioned on the tips of the brush chains, toward the sleeve 4 in the developing region is relatively weak. In the developing region, the carrier grains are subject to a centrifugal force ascribable to the movement of the surface of the sleeve 4 and an electrostatic force ascribable to the surface of the drum 1 or toner grains deposited thereon. These forces are combined to urge the carrier grains toward the drum 1. As for the carrier C1, because the saturation magnetization value is as small as $25\times10^{-7}\times4$ πWb·m/kg, the restraining force urging the carrier C1 toward the sleeve 4 yields to the above composite force. This is presumably why much of the carrier C1 moved toward and deposited on the drum 1.

On the other hand, as for the carrier C2 or C3 with a saturation magnetization value of $40\times10^{-7}\times4$ πWb·m/kg or above, the restraining force urging the carrier grains toward the sleeve 4 overcomes the composite force acting toward the drum 1. This is presumably why the carrier C2 or C3 on the tips of the brush chains was sufficiently prevented from moving toward and depositing on the drum 1.

A saturation magnetization value of $60\times10^{-7}\times4$ πWb·m/kg or above results in an excessive restraining force to act on the carrier grains in the developing region. As a result, the brush chains formed on the sleeve 4 become excessively tight and degrade the tonality of an image and the reproducibility of halftone, as determined by experiments.

As stated above, Experiment 1 showed that when the saturation magnetization value of the carrier was $40\times10^{-7}\times4$ πWb·m/kg or above, but below $60\times10^{-7}\times4$ πWb·m/kg, carrier deposition on the drum 1 was sufficiently reduced. Therefore, there can be reduced white spots and other image defects ascribable to the carrier grains deposited on the drum 1 as well as damage to various parts arranged around the drum 1.

[Experiment 2]

The toner T and each of the carriers C4 and C5 were mixed together to prepare two developers having a toner content of 5 wt %. Again, the laser printer with the developing device 2 was operated to output ten prints with each of the two developers. The prints were then estimated as to the number of white spots for a single print.

FIG. 15 lists the results of Experiment 2. As shown, when the developer containing the carrier C1 with a static resistance of 16.2 log Ω was used, the mean number of white spots for a single print was thirty-eight point three. By contrast, the mean number of white spots for a single print was seven point nine when the developer containing the carrier C4 with 12.4 log Ω was used or ten point five when the developer containing the carrier C5 with 13.8 log Ω was used. By extended studies, we found that when the static resistance was as low as 12 log Ω or above, but 14 log Ω or below, carrier deposition on the drum 1 was less conspicuous than when the static resistance was above 14 log Ω. This will be described more specifically hereinafter.

The carrier grains in the developing zone are subjected not only to the centrifugal force but also to the electrostatic force exerted by the drum, as stated earlier. The electrostatic force attracts the carrier grains of the magnet brush toward the drum 1. The carrier grains on the tips of the brush chains adjoin the surface of the drum 1, so that a charge opposite in polarity to the charge present on the drum 1 is induced on the surface of the individual carrier grain facing the drum 1. As a result, the carrier grains are attracted toward the drum 1 due to the electrostatic force exerted by the surface of the drum 1. The electrostatic force increases with an increase in the amount of charge induced on the individual carrier grain.

As for the carrier C1 with the relatively high static resistance of 16.2 log Ω, a relatively great amount of charge is induced due to the surface charge of the drum 1. Therefore, a relatively strong electrostatic force acts on the carrier C1 and attracts it toward the drum 1 This is presumably why the restraining force urging the carrier C1 toward the sleeve 4 yields to the previously mentioned composite force, causing much of the carrier C1 to move toward and deposit on the drum 1.

By contrast, as for the carrier C4 or C5 whose static resistance is between 12 log Ω and 14 log Ω, the amount of charge induced by the surface charge of the drum 1 is relatively small, so that the electrostatic force exerted by the surface of the drum 1 on the carrier C4 or C5 is relatively weak. In this condition, the force attracting the carrier C4 or C5 toward the drum 1 is weak. Therefore, the restraining force urging the carrier C4 or C5 toward the sleeve 4 overcomes the composite force attracting the carrier it toward the drum 1. This is presumably why carrier deposition on the drum 1 was sufficiently reduced.

To lower the static resistance of the carrier, it is necessary to reduce the thickness of the coating layer covering the individual carrier grain. However, when the coating layer was so thinned as to implement a carrier whose static resistance was less than 12 log Ω, the life of the carrier was reduced and make charging unstable, disturbing a latent image formed on the drum 1.

As stated above, Experiment 2 showed that when the static resistance of the carrier was between 12 log Ω and 14 log Ω, carrier deposition on the drum 1 was sufficiently reduced. Therefore, there can be reduced white spots and other image defects ascribable to the carrier grains 6 deposited on the drum 1 as well as damage to various parts arranged around the drum 1.

[Experiment 3]

The toner T and each of the carriers C5 through C7 were mixed together to prepare two developers having a toner content of 5 wt %. Again, the laser printer with the developing device 2 was operated to output ten prints with each of the two developers as in Experiment 1. The prints were then estimated as to the number of white spots for a single print.

FIG. 16 shows the results of Experiment 3. As shown, when the developer containing the carrier C6 with the fluidity of 25 sec/50 g was used, the mean number of white spots for a single print was twelve point nine. By contrast, the mean number of white spots for a single print was ten point five when the developer containing the carrier C5 with the fluidity of 35 sec/50 g was used or seven point eight when the developer containing the carrier C7 with the fluidity of 42 sec/50 g was used. By extended studies, we found that when the fluidity of the carrier was low, carrier deposition on the drum 1 was apt to occur, and that fluidity lying in the range of from 20 sec/50 g to 40 sec/50 g reduced carrier deposition while insuring high image quality. This will be described more specifically hereinafter.

For a given magnet roller 5, the length and density of the magnet brush vary in accordance with the fluidity of the developer or that of the carrier, noticeably effecting image quality. More specifically, when fluidity is low, i.e., the developer is dry, the developer weakly rises and forms a soft magnet brush to thereby enhance image quality. However, if fluidity is lower than 20 sec/50 g, then carrier deposition on the drum 1 is apt to occur while image density is easily lowered.

Carrier fluidity above 40 sec/50 g, which lowers developer fluidity, makes the magnet brush harder and more dense and thereby degrades the tonality of an image and halftone reproducibility. This is presumably because the hard, dense brush portion strongly rubs the surface of the drum 1.

As stated above, Experiment 3 showed that when carrier fluidity was between 20 sec/50 g and 40 sec/50 g, carrier deposition on the drum 1 was effectively reduced while image density and tonality were enhanced.

As for a relation between developer fluidity and carrier fluidity developer fluidity is higher than carrier fluidity by 9.8 sec/50 g in average as far as the carriers C1 through C9 are concerned. It follows that if carrier fluidity is between 30 sec/50 g and 50 sec/50 g, preferably between 30 sec/50 g and 45 sec/50 g, then it is also possible to enhance tonality and halftone reproducibility while reducing carrier deposition on the drum 1.

[Experiment 4]

The toner T and each of the carriers C8 and C9 were mixed together to prepare two developers having a toner content of 5 wt %. The amount of charge deposited on toner was 10.5 μC/g in the case of the developer contained the carrier C8 or 39.4 μC/g in the case of the developer contained the carrier C9. The developers had a fluidity of 43 sec/50 g each. Again, the laser printer with the developing device 2 was operated to output ten prints with each of the two developers as in Experiment 1. The prints were then estimated as to the number of white spots for a single print.

FIG. 17 lists the results of Experiment 4. As shown, when the developer consisting of the carrier C9 and toner charged to 39.3 μC/g was used, the mean number of white spots for a single print was twelve point six. By contrast, the mean number of white spots was six point nine when use was made of the developer consisting of the carrier C8 and toner charged to 10.5 μC/g. By extended studies, we found that when the amount of charge deposited on the toner was great, carrier deposition on the drum 1 was apt to occur, and that when the amount of charge was between 10 μC/g and 40 μC/g, carrier deposition on the drum 1 was effectively reduced while insuring high image quality. This will be described more specifically hereinafter.

The toner deposited on the drum 1 exerts an electrostatic force that attracts the carrier in the developing zone toward the drum 1 and increases with an increase in the amount of charge deposited on the toner. Presumably, therefore, when the amount of charge deposited on the toner is great, the carrier is easily attracted toward and deposited on the drum 1. If the amount of charge deposited on the toner is 10 μC/g or below, then adhesion acting between the toner and the carrier is so weak, the toner is apt to fly about. In addition, the mobility of the toner toward the latent image on the drum 1 is short in the developing zone, resulting in low image density.

On the other hand, if the amount of charge deposited on the toner is above 40 μC/g, then adhesion acting between the toner and the carrier is so strong and makes it difficult for the toner to part from the carrier. As a result, the carrier is apt to move toward the drum 1 together with the toner in the developing zone and deposit on the drum 1.

As stated above, Experiment 4 showed that when the amount of charge deposited on the toner is between 10 C/g and 40 C/g, not only carrier deposition on the drum 1 was effectively reduced, but also toner scattering and short image density were obviated.

As stated above, the illustrative embodiment achieves various advantages, as enumerated below.

(1) The developing device is of the type causing the developer carrier to move at a linear velocity of 150 mm/sec or above, but lower than 500 mm/sec, as measured in the developing zone, forming a short magnet brush, and providing part of the magnet brush contacting the image carrier with high density. In the magnetic field formed in the developing zone, the restraining force acting on the carrier grains positioned on the tips of brush chains can be sufficiently intensified. Therefore, in a medium-speed image forming apparatus in which an image carrier moves at a linear velocity of 100 mm/sec or above, but 300 mm/sec or below, in the developing zone, it is possible to reduce carrier deposition on the image carrier while maintaining high image density.

(2) The intense restraining force acting on the above carrier grains allows the tips of the brush chains to surely rub the surface of the image carrier. This increases the amount of toner to be fed to a latent image formed on the image carrier for thereby realizing high image density.

(3) Even when the developing device of the type described is applied to the medium-speed image forming apparatus, it is possible to reduce carrier deposition on the image carrier while maintaining high image quality.

Second Embodiment

This embodiment is mainly directed toward the second object stated earlier. The illustrative embodiment is substantially identical with the previous embodiment except for the following.

In the illustrative embodiment, the drum 1 is provided with a diameter of 100 mm and caused to move at a linear velocity of 330 mm/sec, as measured in the developing zone. Also, the sleeve 4 is provided with a diameter of 25 mm and caused to move at a linear velocity of 660 mm/sec, as measured in the developing zone. The linear velocity ratio of the sleeve 4 to the drum 1 is therefore 2.0.

Also, in the illustrative embodiment, to reduce carrier deposition on the drum 1 while insuring high image quality, use is made of carrier grains whose saturation magnetization value is between $60\times10^{-7}\times4$ πWb·m/kg and $90\times10^{-7}4$ πWb·m/kg.

Four different experiments conducted with the laser printer of the illustrative embodiment will be described hereinafter. First, the compositions and producing methods of toner T and carriers C10 through 18 will be described. The toner T is identical with the toner T of the previous embodiment and will not be described in order to avoid redundancy.

(Production of Carrier 10)

Again, the substances listed in FIG. 10 were processed in the same manner as the substances of the carrier C1 to thereby produce carrier grains C10. The ferrite grains had a mean grain size of 55 μm, a saturation magnetization value of $40\times10^{-7}\times4$ πWb·m/kg, a current value of 22 μA, and a fluidity of 25 sec/50 g. The carrier grains C10 had a static resistance of 16.2 log Ω, a fluidity of 29 sec/50 g, and a saturation magnetization value of $40\times10^{-7}4$ πWb·m/kg. The carrier C10 thus produced is conventional.

(Production of Carrier C11)

Carrier grains C11 were produced in the same manner as the carrier C2 by use of the substances listed in FIG. 11. The ferrite grains had a mean grain size of 55 μm and a saturation magnetization value of $60\times10^{-7}\times4$ πWb·m/kg. The carrier C11 had a mean grain size of 55 μm and a saturation magnetization value of $60\times10^{-7}\times4$ πWb·m/kg.

(Production of Carrier C12)

Carrier grains C12 were produced in the same manner as the carrier C3 by use of the substances listed in FIG. 11. The ferrite grains had a mean grain size of 55 μm and a saturation magnetization value of $90\times10^{-7}\times4$ πWb·m/kg. The carrier C12 had a mean grain size of 55 μm and a saturation magnetization value of $90\times10^{-7}\times4$ πWb·m/kg.

(Production of Carrier C13)

Carrier grains C13 were produced in the same manner as the carrier grains C4 by use of the substances listed in FIG. 10. The ferrite grains had a mean grain size of 55 μm, a saturation magnetization value of $75\times10^{-7}\times4$ πWb·m/kg, a current value of 60 μA, and a fluidity of 25 sec/50 g. The carrier grains C13 had a static resistance of 12.4 log Ω, a fluidity of 29 sec/50 g, and a saturation magnetization value of $75\times10^{-7}4$ πWb·m/kg.

(Production of Carrier C14)

Carrier grains C14 were produced in the same manner as the carrier C5 by use of the substances listed in FIG. 12. The ferrite grains had a mean grain size of 55 μm, a saturation magnetization value of $75\times10^{-7}\times4$ πWb·m/kg; and a current value of 30 μA. The carrier C14 had a static resistance of 13.8 log Ω, a fluidity of 35 sec/50 g, and a saturation magnetization value of $75\times10^{-7}\times4$ πWb·m/kg.

(Production of Carrier C15)

Carrier grains C15 were produced in the same manner as the carrier C6 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 20 sec/50 g. The carrier grains C15 had a static resistance of 13.8 log Ω, a fluidity of 25 sec/50 g, and a saturation magnetization value of $75\times10^{-7}\times4$ πWb·m/kg.

(Production of Carrier C16)

Carrier grains C16 were produced in the same manner as the carrier C7 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 30 sec/50 g. The carrier grains C16 had a static resistance of 13.8 log Ω, a fluidity of 42 sec/50 g, and a saturation magnetization value of $75\times10^{-7}\times4$ πWb·m/kg.

(Production of Carrier C17)

Carrier grains C17 were produced in the same manner as the carrier C8 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 25 sec/50 g. The carrier grains C17 had a static resistance of 13.8 log Ω, a fluidity of 33 sec/50 g, and a saturation magnetization value of $75\times10^{-7}\times4$ πWb·m/kg.

(Production of Carrier C18)

Carrier grains C18 were produced in the same manner as the carrier C9 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 25 sec/50 g. The carrier grains C18 had a static resistance of 13.8 log Ω, a fluidity of 33 sec/50 g, and a saturation magnetization value of $75\times10^{-7}\times4$ πWb·m/kg.

The methods used to measure the characteristics of toner grains and those of carrier grains are identical with the methods of the first embodiment and will not be described specifically.

[Experiment 5]

Experiment 5 to be described is identical with Experiment 1 except for the following. FIG. 18 lists the results of Experiment 5. As shown, when the developer containing the carrier C10 whose saturation magnetization value was $40\times10^{-7}\times4$ πWb·m/kg was used, twenty-five point eight dots appeared for a single print. By contrast, the developers containing the carriers C11 and C12 whose saturation magnetization values were $60\times10^{-7}\times4$ πWb·m/kg and $90\times10^{-7}\times4$ πWb·m/kg, respectively, derived nine point six white spots and four point three white spots, respectively. It was therefore determined that when the saturation magnetization value of the carrier was between $60\times10^{-7}\times4$ πWb·m/kg and $90\times10^{-7}\times4$ πWb·m/kg, carrier deposition on the drum 1 was less conspicuous than when the saturation magnetization value was less than $60\times10^{-7}\times4$ πWb·m/kg. This will be described more specifically hereinafter.

The attenuation ratio is as high as 53.5% in the illustrative embodiment. Therefore, the magnetic restraining force urging the carrier grains, which are positioned on the tips of the brush chains, toward the sleeve 4 in the developing zone is relatively weak. In the developing zone, the carrier grains are subject to a centrifugal force derived from the movement of the surface of the sleeve 4 and an electrostatic force derived from the surface of the drum 1 or toner grains deposited thereon. These forces are combined to urge the carrier grains toward the drum 1. As for the carrier C10, because the saturation magnetization value is as small as $40\times10^{-7}\times4$ πWb·m/kg, the restraining force urging the carrier C10 toward the sleeve 4 yields to the above composite force. This is presumably why much of the carrier C10 moved toward and deposited on the drum 1.

On the other hand, as for the carrier C11 or C12 with a saturation magnetization value of $60\times10^{-7}4$ πWb·m/kg or above, the restraining force urging the carrier grains toward the sleeve 4 overcomes the composite force acting toward the drum 1. This is presumably why the carrier C11 or C12 on the tips of the brush chains was sufficiently prevented from moving toward and depositing on the drum 1.

A saturation magnetization value above $90\times10^{-7}\times4$ πWb·m/kg or above results in an excessive restraining force to act on the carrier grains in the developing zone. As a result, the brush chains formed on the sleeve 4 becomes excessively tight and degrades the tonality of an image and the reproducibility of halftone, as determined by experiments.

As stated above, Experiment 5 showed that when the saturation magnetization value of the carrier was between $60\times10^{-7}\times4$ πWb·m/kg and $90\times10^{-7}\times4$ πWb·m/kg, carrier deposition on the drum 1 was sufficiently reduced. Therefore, there can be reduced white spots and other image defects ascribable to the carrier grains deposited on the drum 1 as well as damage to various parts arranged around the drum 1.

[Experiment 6]

The toner T and each of the carriers C10, C13 and C14 were mixed together to prepare two developers having a toner content of 5 wt %. Again, the laser printer with the developing device 2 used in Experiment 5 was operated to output ten prints with each of the two developers. The prints were then estimated as to the number of white spots for a single print.

FIG. 19 lists the results of Experiment 6. As shown, when the developer containing the carrier C10 with a static resistance of 16.2 log Ω was used, the mean number of white spots for a single print was twenty-five point eight. By contrast, the mean number of white spots for a single print was eight point seven when the developer containing the carrier C3 with 12.4 log Ω was used or twelve point six when the developer containing the carrier C14 with 13.8 log Ω was used. By extended studies, we found that when the static resistance was as low as 12 log Ω or above, but 14 log Ω or below, carrier deposition on the drum 1 was less conspicuous than when the static resistance was above 14 log Ω. This will be described more specifically hereinafter.

The carrier grains in the developing zone are subject not only to the centrifugal force but also to the electrostatic force exerted by the drum 1, as stated earlier. The electrostatic force attracts the carrier grains of the magnet brush toward the drum 1. The carrier grains on the tips of the brush chains adjoin the surface of the drum 1, so that a charge opposite in polarity to the charge present on the drum 1 is induced on the surface of the individual carrier grain facing the drum 1. As a result, the carrier grains are attracted toward the drum 1 due to the electrostatic force exerted by the surface of the drum 1. The electrostatic force increases with an increase in the amount of charge induced on the individual carrier grain.

As for the carrier C10 with the relatively high static resistance of 16.2 log Ω, a relatively great amount of charge is induced due to the surface charge of the drum 1. Therefore, a relatively strong electrostatic force acts on the carrier C10 and attracts the carrier C1 toward the drum 1. This is presumably why the restraining force urging the carrier C10 toward the sleeve 4 yielded to the previously mentioned composite force, causing much of the carrier C10 to move toward and deposit on the drum 1.

By contrast, as for the carrier C13 or C14 whose static resistance is between 12 log Ω and 14 log Ω, the amount of charge induced by the surface charge of the drum 1 is relatively small, so that the electrostatic force exerted by the surface of the drum 1 on the carrier C13 or C14 is relatively weak. In this condition, the force attracting the carrier C13 or C14 toward the drum 1 is weak. Therefore, the restraining force urging the carrier C13 or C14 toward the sleeve 4 overcomes the composite force attracting the carrier C13 or C14 toward the drum 1. This is presumably why carrier deposition on the drum 1 was sufficiently reduced.

To lower the static resistance of the carrier, it is necessary to reduce the thickness of the coating layer covering the individual carrier grain. However, when the coating layer was so thinned as to implement a carrier whose static resistance was less than 12 log Ω, the life of the carrier was reduced and make charging unstable, disturbing a latent image formed on the drum 1.

As stated above, Experiment 6 showed that when the static resistance of the carrier was between 12 log Ω and 14 log Ω, carrier deposition on the drum 1 was sufficiently reduced. Therefore, there can be reduced white spots and other image defects ascribable to the carrier grains deposited on the drum 1 as well as damage to various parts arranged around the drum 1.

[Experiment 7]

The toner T and each of the carriers C14 through C16 were mixed together to prepare two developers having a toner content of 5 wt %. Again, the laser printer with the developing device 2 used in Experiment 5 was operated to output ten prints with each of the two developers as in Experiment 1. The prints were then estimated as to the number of white spots for a single print.

FIG. 20 shows the results of Experiment 7. As shown, when the developer containing the carrier C15 with the fluidity of 25 sec/50 g was used, the mean number of white spots for a single print was fourteen point eight. By contrast, the mean number of white spots for a single print was twelve point six when the developer containing the carrier C14 with the fluidity of 35 sec/50 g was used or eight point four when the developer containing the carrier C16 with the fluidity of 42 sec/50 g was used. By extended studies, we found that when the fluidity of the carrier was low, carrier deposition on the drum 1 was apt to occur, and that fluidity lying in the range of from 20 sec/50 g to 40 sec/50 g reduced carrier deposition while insuring high image quality. This will be described more specifically hereinafter.

For a given magnet roller 5, the length and density of the magnet brush vary in accordance with the fluidity of the developer or that of the carrier, noticeably effecting image quality. More specifically, when fluidity is low, i.e., the developer is dry, the developer weakly rises and forms a soft magnet brush to thereby enhance image quality. However, if fluidity is lower than 20 sec/50 g, then carrier deposition on the drum 1 is apt to occur while image density is easily lowered.

Carrier fluidity above 40 sec/50 g, which lowers developer fluidity, makes the magnet brush harder and more dense and thereby degrades the tonality of an image and the reproducibility of halftone. This is presumably because the hard, dense brush portion strongly rubs the surface of the drum 1.

As stated above, Experiment 7 showed that when carrier fluidity was between 20 sec/50 g and 40 sec/50 g, carrier deposition on the drum 1 was effectively reduced while image density and tonality were enhanced.

As for a relation between developer fluidity and carrier fluidity, developer fluidity is higher than carrier fluidity by 9.8 sec/50 g in average as far as the carriers C10 through C18 are concerned. It follows that if carrier fluidity is between 30 sec/50 g and 50 sec/50 g, preferably between 30 sec/50 g and 45 sec/50 g, then it is also possible to enhance tonality and halftone reproducibility while reducing carrier deposition on the drum 1.

[Experiment 8]

The toner T and each of the carriers C17 and C18 were mixed together to prepare two developers having a toner content of 5 wt %. The amount of charge deposited on toner was 10.2 $\mu$C/g in the case of the developer containing the carrier C17 or 39.7 $\mu$C/g in the case of the developer containing the carrier C18. The developers had a fluidity of 43 sec/50 g each. Again, the laser printer with the developing device 2 used in Experiment 5. was operated to output ten prints with each of the two developers as in Experiment 5. The prints were then estimated as to the number of white spots for a single print.

FIG. 21 lists the results of Experiment 8. As shown, when the developer consisting of the carrier C18 and toner charged to 39.3 $\mu$C/g was used, the mean number of white spots for a single print was eleven point three. By contrast, the mean number of white spots was seven point nine when use was made of the developer consisting of the carrier C17 and toner charged to 10.2 $\mu$C/g. By extended studies, we found that when the amount of charge deposited on the toner was great, carrier deposition on the drum 1 was apt to occur, and that when the amount of charge was between 10 $\mu$C/g and 40 $\mu$C/g, carrier deposition on the drum 1 was effectively reduced while insuring high image quality. This will be described more specifically hereinafter.

The toner deposited on the drum 1 exerts an electrostatic force that attracts the carrier in the developing zone toward the drum 1 and increases with an increase in the amount of charge deposited on the toner. Presumably, therefore, when the amount of charge deposited on the toner is great, the carrier is easily attracted toward and deposited on the drum 1. If the amount of charge deposited on the toner is 10 $\mu$C/g or below, then adhesion acting between the toner and the carrier is so weak, the toner is apt to fly about. In addition, the mobility of the toner toward the latent image on the drum 1 is short in the developing zone, resulting in low image density.

On the other hand, if the amount of charge deposited on the toner is above 40 $\mu$C/g, then adhesion acting between the toner and the carrier is so strong and makes it difficult for the toner to part from the carrier. As a result, the carrier is apt to move toward the drum 1 together with the toner in the developing zone and deposit on the drum 1.

As stated above, Experiment 8 showed that when the amount of charge deposited on the toner is between 10 $\mu$C/g and 40 $\mu$C/g, not only carrier deposition on the drum 1 was effectively reduced, but also toner scattering and short image density were obviated.

As stated above, the illustrative embodiment achieves various advantages, as enumerated below.

(1) The developing device is of the type causing the developer carrier to move at a linear velocity of 500 mm/sec or above, but lower than 1,200 mm/sec, as measured in the developing zone, forming a short magnet brush, and providing part of the magnet brush contacting the image carrier with high density, in the magnetic field formed in the developing zone, the restraining force acting on the carrier grains positioned on the tips of brush chains can be sufficiently intensified. Therefore, in a medium-speed image forming apparatus in which an image carrier moves at a linear velocity of 100 mm/sec or above, but 300 mm/sec or below, in the developing zone (medium-speed machine), it is possible to reduce carrier deposition on the image carrier while maintaining high image density.

(2) The intense restraining force acting on the above carrier grains allows the tips of the brush chains to surely rub the surface of the image carrier. This increases the amount of toner to be fed to a latent image formed on the image carrier for thereby realizing high image density.

(3) Even when the developing device of the type described is applied to the medium-speed image forming apparatus in which an image carrier moves at a linear velocity of 300 mm/sec or above, but 600 mm/sec or below, it is possible to reduce carrier deposition on the image carrier while maintaining high image quality.

Third Embodiment

This embodiment is mainly directed toward the third object stated earlier. The illustrative embodiment is also substantially identical with the first embodiment except for the following.

Figure 22:
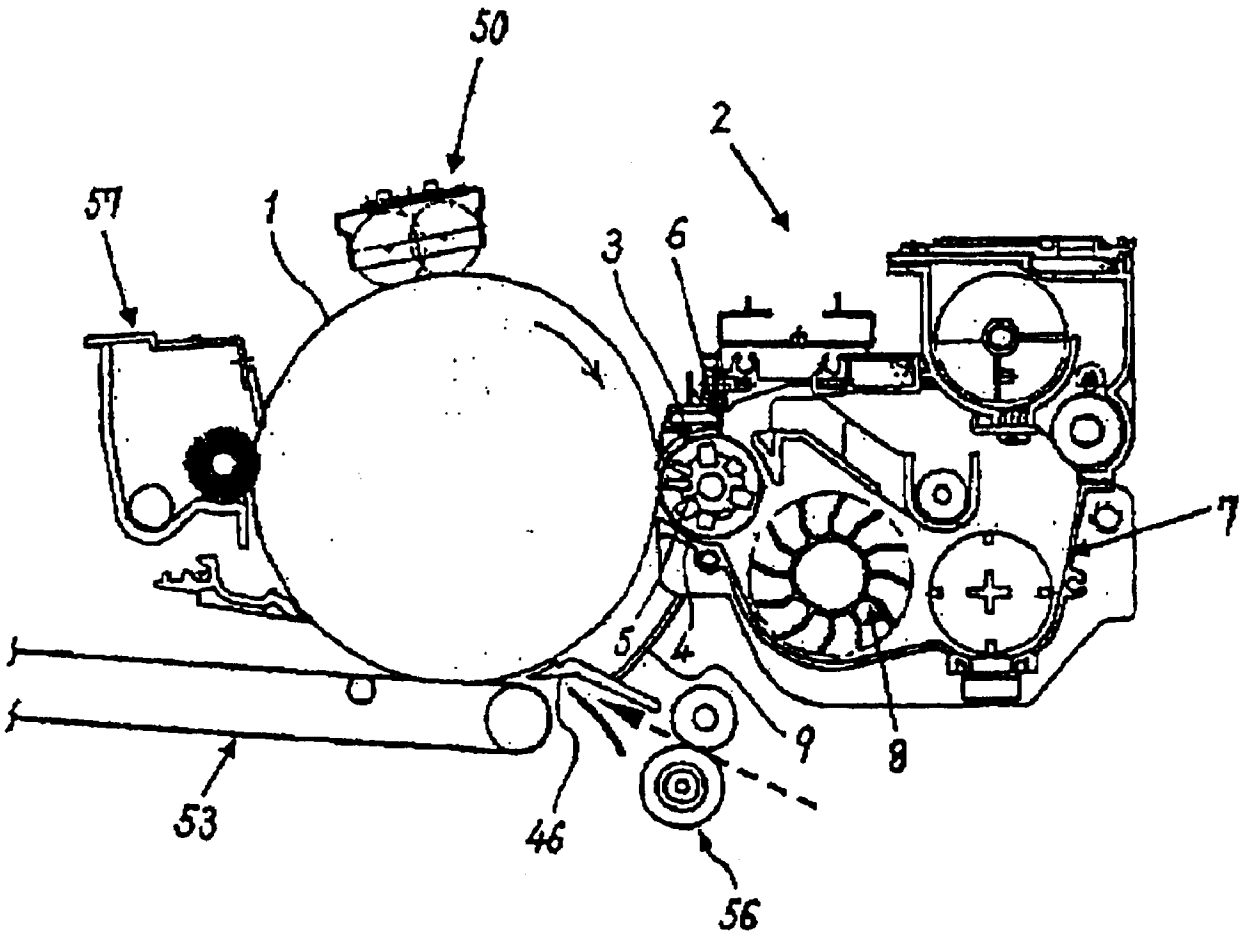
FIG. 22 shows a photoconductive drum and arrangements therearound representative of a third embodiment of the present invention.

As shown in FIG. 22, the developing device 2 additionally includes a guide 46 for guiding the sheet moved away from the registration roller pair 56 to the image transfer position, and a Mylar sheet 9 extending between the chin portion of the casing 7 and the guide 46. The Mylar sheet 9 prevents the carrier and toner flying out of the casing 7 via the opening, which faces the drum 1, from smearing the sheet, registration roller pair 56 and so forth.

In the illustrative embodiment, the drum 1 has a diameter of 100 mm and moves at a linear velocity of 330 mm/sec in the developing zone. The sleeve 4 has a diameter of 25 mm and moves at a linear velocity of 660 mm/sec in the developing zone, so that the linear speed ratio is 2.0. It should be noted that required image density is achievable with the illustrative embodiment even when the linear velocity ratio of the sleeve 4 to the drum 1 is reduced to 1.5.

Figure 23:
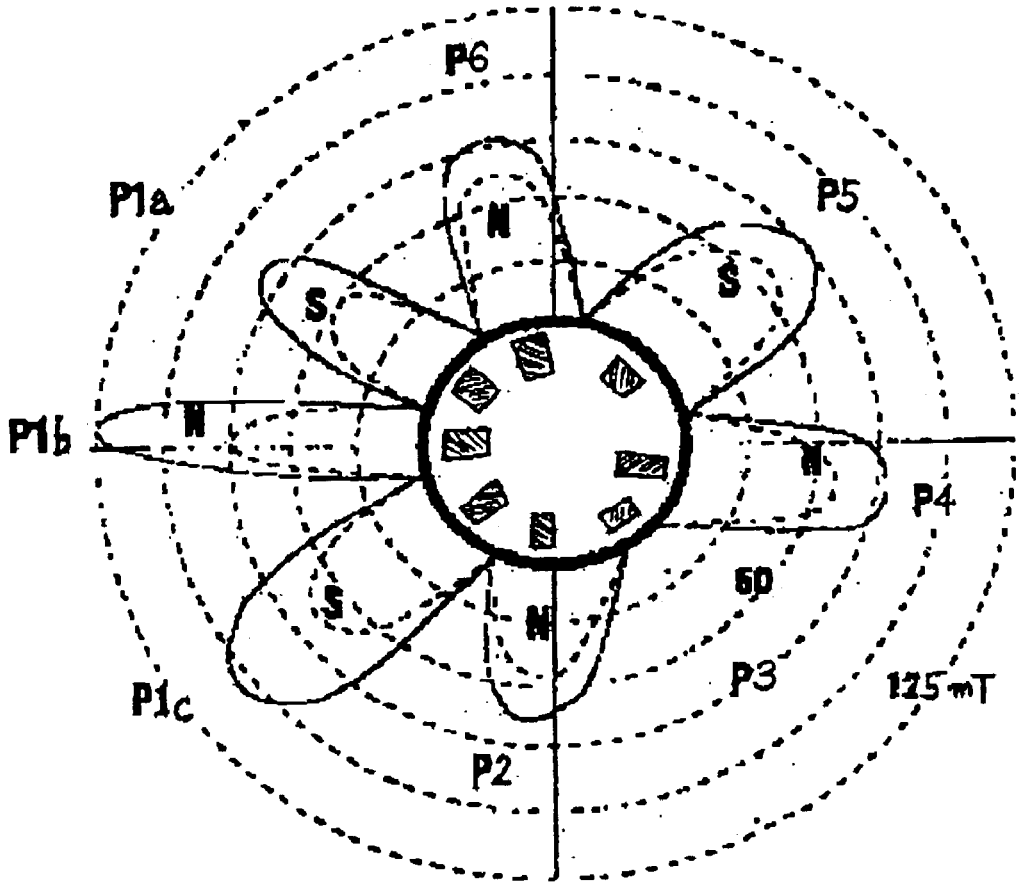
FIG. 23 is a circle chart showing the distributions of flux densities generated on a sleeve, which is included in the third embodiment, in the normal direction by the magnetic poles of a magnet roller.

FIG. 23 shows the arrangement of the magnet roller 5 included in the illustrative embodiment. As shown, in the illustrative embodiment the magnet roller 5 also has the main magnetic pole P1*b* for forming the magnetic field that causes the developer to form a magnet brush in the developing zone. The auxiliary magnetic poles P1*a* and P1*c* adjoin the main pole P1*b* at the upstream side and downstream side, respectively, in the direction of movement of the sleeve surface. The poles P1*a*, P1*b* and P1*c* each are implemented as a magnet having a small sectional area.

Figure 24:
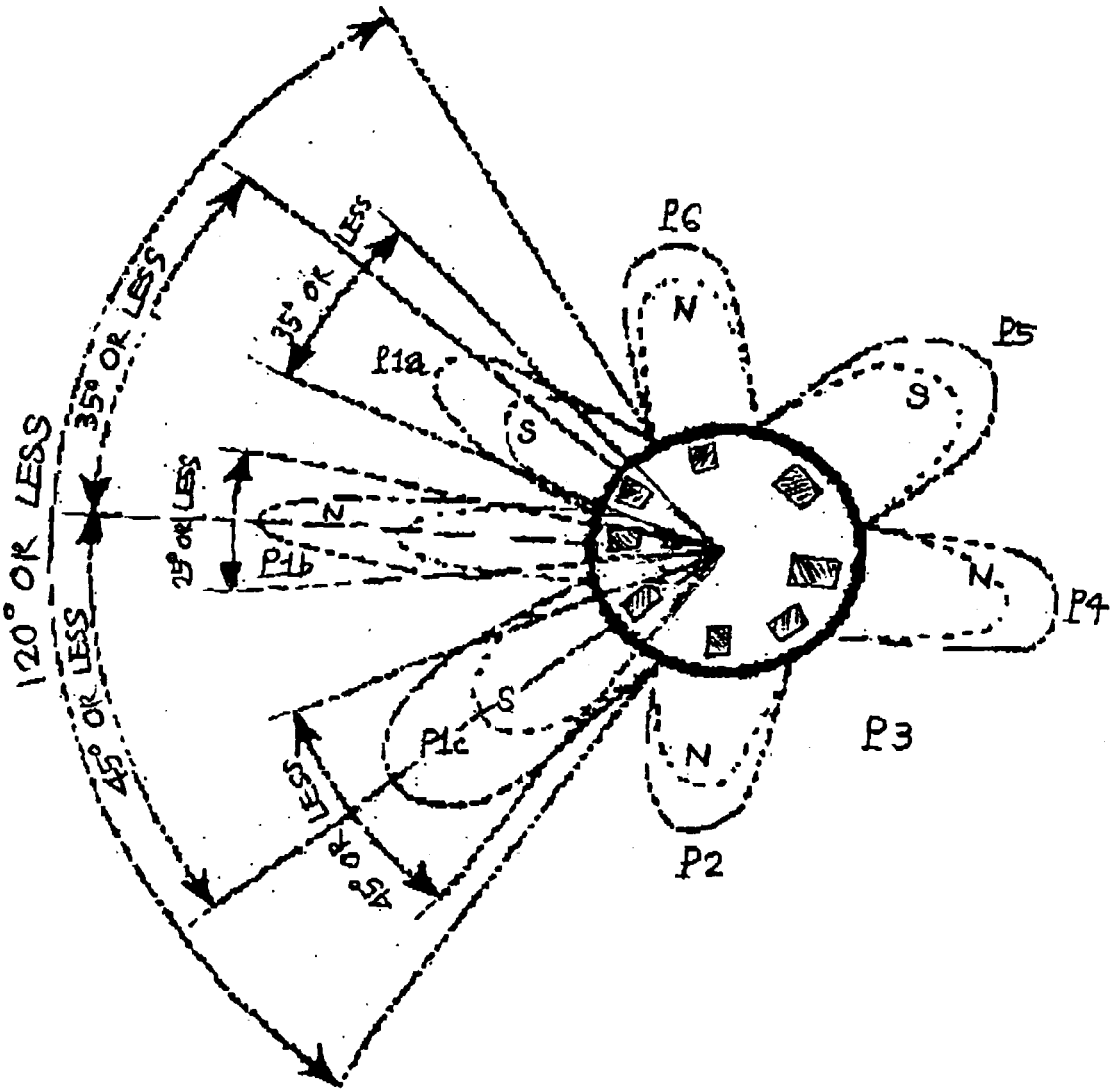
FIG. 24 shows the arrangement of three of the magnetic poles shown in FIG. 23 that constitute a pole for development.

In the illustrative embodiment, as shown in FIG. 24, the half-value angular width of the upstream auxiliary pole P1*a* is selected to be 35° or less while the half-value angular width of the downstream auxiliary pole P1*c* is selected to be 45° or less. Also, the main pole P1*b* and auxiliary pole are positioned relative to each other such that a placement angular width between them is 35° or less. On the other hand, the main pole P1*b* and auxiliary pole P1*c* are positioned relative to each other such that a placement angular width between them is 45° or less. The placement angle refers to an angular width in the direction of movement of the sleeve surface between the points on the sleeve 4 where the normal flux density of the main pole P1*b* and that of the auxiliary pole P1*a* or P1*c* have peak values, as seen from the axis of the sleeve 4.

In the illustrative embodiment, the half-value angular width of the main pole P1*b* is 16°, as stated earlier. Therefore, the placement angle between the main pole P1*b* and the auxiliary pole P1*a* and the placement angle between the main pole P1*b* and the auxiliary pole P1*c* are selected to be 25° and 40°, respectively.

In the above configuration, the magnetic characteristics of the poles P1*a* through P1*c* were measured, as will be described hereinafter. The normal flux density of the main pole P1*b* had a peak value of 120 mT, as measured on the surface of the sleeve 4. The normal flux density at a position spaced from the sleeve 4 by 1 mm was 72.2 mT. Therefore, the attenuation ratio was 41.8%.

The normal flux density of the auxiliary pole P1*a* upstream of the main pole P1*b* had a peak value of 85 mT, as measured on the surface of the sleeve 4. The normal flux density at a position spaced from the sleeve 4 by 1 mm was 49.8 mT. The attenuation ratio was therefore 41.4%.

Further, the normal flux density of the auxiliary pole P1*c* downstream of the main pole P1*b* had a peak value of 105 mT, as measured on the surface of the sleeve 4. The normal flux density at a position spaced from the sleeve 4 by 1 mm was 60.5 mT. The attenuation ratio was therefore 42.4%.

Figure 25:
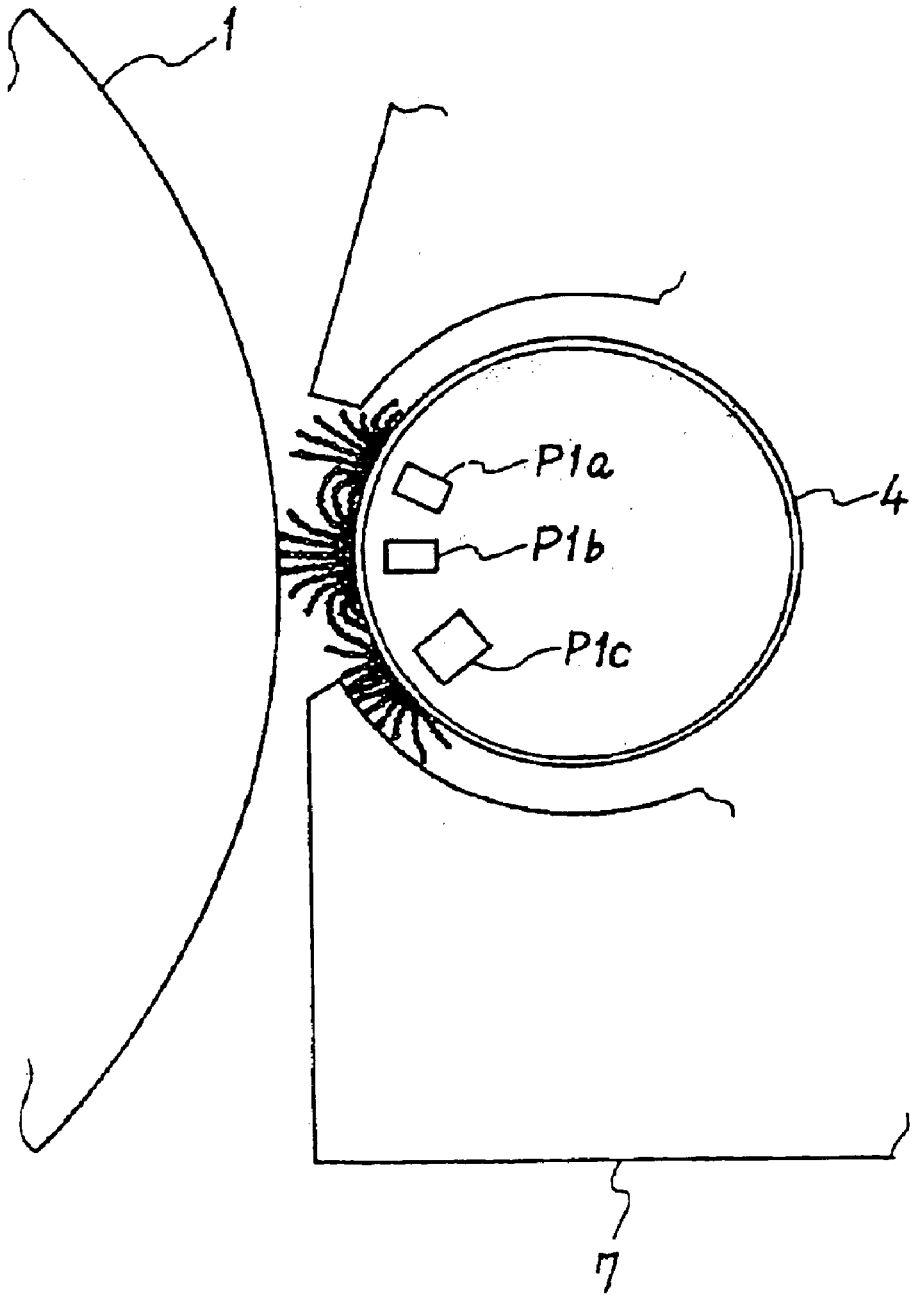
FIG. 25 shows the configuration of the casing of a developing device particular to the third embodiment.

FIG. 25 illustrates the arrangement of the magnet roller 5 and casing 7 characterizing the illustrative embodiment. Carrier grains on the tips of the brush chains risen along the magnetic lines of force, which are generated by the auxiliary pole P1*c*, are likely to part from the magnet brush, as stated earlier. In light of this, as shown in FIG. 25, the casing 7 is so configured as to cover the developer caused to rise by the auxiliary pole P1*c*. This configuration is achieved because the auxiliary pole P1*c* is remote from the main pole P1*b*.

More specifically, assume that the downstream auxiliary pole P1*c* is identical with the upstream auxiliary pole P1*a* as to placement angular width, i.e., 25°. Then, the developer caused to rise on the sleeve 4 by the auxiliary pole P1*c* is too close to the developing zone. The casing 7 would therefore contact the drum 1 if configured to cover the developer caused to rise by the auxiliary pole P1*c*. In the illustrative embodiment, the placement angular width of the P1*c* relative to the main pole P1*b* is 40°, as stated earlier, and implements the configuration of the casing 7 shown in FIG. 25. Such a distance between the main pole P1*b* and the auxiliary pole P1*c* reduces the attenuation ratio or increases the half-value angular width with respect to the main pole P1*b*. However, in the illustrative embodiment, the increment of the above distance allows the auxiliary pole P1*c* to exert a stronger magnetic force, thereby realizing the same attenuation ratio and half-width angular width as achievable with the small distance.

In the illustrative embodiment, to reduce carrier scattering for increasing image density, the carrier grains have a saturation magnetization value of $60\times10^{-7}\times4$ πWb·m/kg or above, but $90\times10^{-7}\times4$ πWb·m/kg or below.

In the illustrative embodiment, the method of coating the cores of the carrier grains is open to choice and may be any one of dip coating, spray coating, and flow spray coating using a flow coater. The coated carrier grains are subjected to processing for curing and drying. During this processing, heat or heat and moisture may be used to smoothly complete curing and drying. The coating layer on the individual carrier grain is about 2 μm or less, preferably between 0.1 μm and 1 μm.

Four different experiments conducted with the laser printer of the illustrative embodiment will be described hereinafter. First, the compositions and producing methods of toner T and carriers C19 and C27 will be described. The toner T is identical with the toner T of the first embodiment and will not be described specifically.

(Production of Carrier C19)

Again, the substances listed in FIG. 10 were processed in the same manner as the substances of the carrier C1 to thereby produce carrier grains C19. The ferrite grains had a mean grain size of 55 μm, a saturation magnetization value of $40\times10^{-7}4$ πWb·m/kg, a current value of 22 μA, and a fluidity of 25 sec/50 g. The carrier grains C19 had a static resistance of 16.2 log Ω, a fluidity of 29 sec/50 g, and a saturation magnetization value of $40\times10^{-7}\times4$ πWb·m/kg. The carrier C19 thus produced is conventional.

(Production of Carrier C20)

Carrier grains C20 were produced in the same manner as the carrier C2 by use of the substances listed in FIG. 11. The ferrite grains had a mean grain size of 55 μm and a saturation magnetization value of $60\times10^{-7}\times4$ πWb·m/kg. The carrier C20 had a mean grain size of 55 μm and a saturation magnetization value of $60\times10^{-7}\times4$ πWb·m/kg.

(Production of Carrier C21)

Carrier grains C21 were produced in the same manner as the carrier C3 by use of the substances listed in FIG. 11. The ferrite grains had a mean grain size of 55 μm and a saturation magnetization value of $90\times10^{-7}4$ πWb·m/kg. The carrier C21 had a mean grain size of 55 μm and a saturation magnetization value of $90\times10^{-7}\times4$ πWb·m/kg.

(Production of Carrier C22)

Carrier grains C22 were produced in the same manner as the carrier grains C4 by use of the substances listed in FIG. 10. The ferrite grains had a mean grain size of 55 μm, a saturation magnetization value of $75\times10^{-7}\times4$ πWb·m/kg, a current value of 60 μA, and a fluidity of 25 sec/50 g. The carrier grains C22 had a static resistance of 12.4 log Ω, a fluidity of 29 sec/50 g, and a saturation magnetization value of $75\times10^{-7}\times4$ πWb·m/kg.

(Production of Carrier C23)

Carrier grains C23 were produced in the same manner as the carrier C5 by use of the substances listed in FIG. 12. The ferrite grains had a mean grain size of 55 μm, a saturation magnetization value of $75\times10^{-7}4$ πWb·m/kg, and a current value of 30 μA. The carrier C14 had a static resistance of 13.8 log Ω, a fluidity of 35 sec/50 g, and a saturation magnetization value of $75\times10^{-7}\times4$ πWb·m/kg.

(Production of Carrier C24)

Carrier grains C24 were produced in the same manner as the carrier C6 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 20 sec/50 g. The carrier grains C24 had a static resistance of 13.8 log Ω, a fluidity of 25 sec/50 g, and a saturation magnetization value of $75\times10^{-7}\times4$ πWb·m/kg.

(Production of Carrier C25)

Carrier grains C25 were produced in the same manner as the carrier C7 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 30 sec/50 g. The carrier grains C25 had a static resistance of 13.8 log Ω, a fluidity of 42 sec/50 g, and a saturation magnetization value of $75\times10^{-7}4$ πWb·m/kg.

(Production of Carrier C26)

Carrier grains C26 were produced in the same manner as the carrier C8 by use of the substances listed in FIG. 11. The ferrite grains had a mean grain size of 55 μm, a saturation magnetization value of $75\times10^{-7}\times4$ πWb·m/kg, a current value of 30 μA, and a fluidity of 25 sec/50 g. The carrier grains C26 had a static resistance of 13.8 log Ω, a fluidity of 33 sec/50 g, and a saturation magnetization value of $75\times10^{-7}\times4$ πWb·m/kg.

(Production of Carrier C27)

Carrier grains C27 were produced in the same manner as the carrier C9 by use of the substances listed in FIG. 11. The ferrite grains had a mean grain size of 55 μm, a saturation magnetization value of $75\times10^{-7}4$ πWb·m/kg, a current value of 30 μA, and a fluidity of 25 sec/50 g. The carrier grains C27 had a static resistance of 13.8 log Ω, a fluidity of 33 sec/50 g, and a saturation magnetization value of $75\times10^{-7}\times4$ πWb·m/kg.

The methods used to measure the characteristics of toner grains and those of carrier grains are identical with the methods of the first example and will not be described specifically.

[Experiment 9]

Experiment 9 compares the case wherein the casing 7 covers the developer raised by the auxiliary pole P1*c* and the case wherein the former does not cover the latter as to carrier scattering out of the developing device.

In Experiment 9, the toner T and each of the carriers C19 through C21 were mixed together to prepare three different developers having a toner content of 5 wt % each. There were prepared two developing devices in which the placement angle between the main pole P1*b* and the auxiliary pole P1*c* were 45° and 35°, respectively. The casing 7 of the developing device with the placement angle of 45° is not configured to cover the developer raised by the auxiliary pole P1*c* while the casing 7 of the developing device with the placement angle of 35° is not configured so. The two developing devices therefore differ from each other as to the magnetic force distribution in the developing zone. Taking this into account, Experiment 9 was conducted by adjusting the magnetic force of the auxiliary pole P1*c* so as to establish substantially the same magnetic force distribution in the developing zone. More specifically, in both of the developing devices, the normal flux density of the main pole P1*b* had a peak value of 120 mT, the attenuation ratio of the normal flux density was 41.8%, and the half-value angular width of the main pole P1*b* was 16°.

Also, in Experiment 9, the ratio of the linear velocity (660 mm/sec) of the sleeve 4 to the linear velocity (330 mm/sec) of the drum 1 was 2.0. 900 g of each of the developers was set in particular one of the two developing devices 2. In this condition, the developing devices each were operated to print an image having an area ratio of 6% on a sheet of size A4 (landscape). After 1,000 prints were output, the weight of carrier grains flown out of each developing device was measured. More specifically, in Experiment 9, the weight of carrier grains deposited on the Mylar sheet 9, FIG. 22, was measured.

FIG. 26 lists the results of Experiment 9. As shown, the developing device with the placement angular width of 45° was found to reduce carrier scattering more than the developing device with the placement angle of 35° with all of the carriers C19 and C21. This means that the casing 7 configured to cover the developer raised by the auxiliary pole P1*c* successfully prevents the carrier grains from flying out of the developing device The auxiliary pole P1*c* is positioned such that a line normal to the sleeve surface at a point where the normal flux density of the auxiliary pole P1*c* has a peak value, as measured on the sleeve surface, is inclined downward. In this condition, not only the centrifugal force and the electrostatic force exerted by the surface of the drum 1 but also gravity act on the carrier grains forming the tips of the brush chains, tending to urge the carrier grains away from the magnet brush. This is apt to aggravate the scattering of the toner grains.

As shown in FIG. 26, in the developing device 2 with the auxiliary pole P1*c* having the placement angular width of 35°, when the developer containing the carrier C19 with the saturation magnetization value of $40\times10^{-7}\times4$ πWb·m/kg was used, 10.7 mg of carrier grains flew out of the developing device 2 for 1,000 prints. Also, when the developers containing the carriers C20 and C21 with the saturation magnetization values of $60\times10^{-7}4$ πWb·m/kg and $90\times10^{-7}\times4$ πWb·m/kg, respectively, were used, only 4.13 mg and 1.72 mg of carrier grains, respectively, flew out of the developing device 2 for 1,000 prints.

As also shown in FIG. 26, in the developing device 2 with the auxiliary pole P1*c* having the placement angular width of 45°, the results of experiments were similar to the results stated above. Specifically, when the developer containing the carrier C19 was used, 3.1 mg of carrier grains flew out of the developing device 2 for 1,000 prints. Also, when the developers containing the carriers C20 and C21 were used, only 1.2 mg and 0.5 mg of carrier grains, respectively, flew out of the developing device 2 for 1,000 prints. It will therefore be seen that when the saturation magnetization value is between $60\times10^{-7}\times4$ πWb·m/kg and $90\times10^{-7}\times4$ πWb·m/kg, carrier scattering can be reduced more than when it is less than $60\times10^{-7}\times4$ πWb·m/kg. This will be described more specifically hereinafter.

The attenuation ratio is as high as 42.4% in the illustrative embodiment. Therefore, magnetic restraint magnetically urging the carrier grains, which are positioned on the tips of the brush chains, toward the sleeve 4 in the developing zone is relatively weak. Moreover, in the developing zone, the carrier grains are subject to the centrifugal force derived from the movement of the surface of the sleeve 4, electrostatic force derived from the surface of the drum 1, and gravity. These forces are combined to urge the carrier grains away from the magnet brush. As for the carrier C19, because the saturation magnetization value is as small as $40\times10^{-7}4$ πWb·m/kg, the restraining force urging the carrier C19 toward the sleeve 4 yields to the above composite force. This is presumably why much of the carrier C19 moved away from the magnet brush.

On the other hand, as for the carrier C20 or C21 with the saturation magnetization value of $60\times10^{-7}4$ πWb·m/kg or above, the restraining force urging the carrier grains toward the sleeve 4 overcomes the composite force. This is presumably why the carrier grains parted from the magnet brush little. When the magnetization saturation value was above $90\times10^{-7}4$ πWb·m/kg, the restraining force acting on the carrier grains was so strong, the magnet brush on the sleeve 4 became tight and deteriorated tonality and halftone reproducibility.

[Experiment 10]

The toner T and each of the carriers C19, C22 and C23 were mixed together to prepare three different developers having a toner content of 5 wt % each. Again, there were prepared two developing devices configured in the same manner as in Experiment 9. Carrier scattering was estimated for 1,000 prints as in Experiment 9.

FIG. 27 shows the results of Experiment 10. As shown, as for the developing device with the auxiliary pole P1*c* having the placement angular width of 35°, 10.7 mg of carrier grains flew out of the developing device 2 for 1,000 prints when use was made of the developer containing the carrier grains C19 having the static resistance of 16.2 log Ω. By contrast, when the developers containing the carrier C22 or C23 having the static resistances of 12.4 log Ω and 13.8 log Ω, respectively, were used, 3.6 mg of carrier grains and 5.3 mg of carrier grains, respectively, flew out of the developing device 2.

As also shown in FIG. 27, similar results were obtained with the developing device 2 with the auxiliary pole P1*c* having the placement angular velocity of 45°. More specifically, when the developer containing the carrier C19 was used, 3.1 mg of carrier grains flew out of the developing device 2 for 1,000 prints. When the developers containing the carriers C22 and C23, respectively were used, 1.1 mg of carrier grains and 1.5 mg of carrier grains, respectively, flew out of the developing device 2 for 1,000 prints. By extended studies, we found that when the static resistance was as low as between 12 log Ω and 14 log Ω, carrier scattering could be reduced more than when it was above 14 log Ω. This will be described more specifically hereinafter.

The carrier grains in the developing zone are subject not only to the centrifugal force but also to the electrostatic force exerted by the drum, as stated earlier. The electrostatic force attracts the carrier grains of the magnet brush toward the drum 1. The carrier grains on the tips of the brush chains adjoin the surface of the drum 1, so that a charge opposite in polarity to the charge present on the drum 1 is induced on the surface of the individual carrier grain facing the drum 1. As a result, the carrier grains are attracted toward the drum 1 due to the electrostatic force exerted by the surface of the drum 1. The electrostatic force increases with an increase in the amount of charge induced on the individual carrier grain.

As for the carrier C19 with the relatively high static resistance of 16.2 log Ω, a relatively great amount of charge is induced due to the surface charge of the drum 1. Therefore, a relatively strong electrostatic force acts on the carrier C19 and attracts the carrier C19 toward the drum 1. This is presumably why the restraining force urging the carrier C19 toward the sleeve 4 yielded to the previously mentioned composite force, causing much of the carrier C19 to move toward and deposit on the drum 1.

By contrast, as for the carrier C22 or C23 whose static resistance is between 12 log Ω and 14 log, the amount of charge induced by the surface charge of the drum 1 is relatively small, so that the electrostatic force exerted by the surface of the drum 1 on the carrier C22 or C23 is relatively weak. In this condition, the force attracting the carrier C22 or C23 toward the drum 1 is weak. Therefore, the restraining force urging the carrier C22 or C23 toward the sleeve 4 overcomes the composite force attracting the carrier C22 or C23 toward the drum 1. This is presumably why the carrier grains on the tips of the brush chains parted from the magnet brush little.

To lower the static resistance of the carrier, it is necessary to reduce the thickness of the coating layer covering the individual carrier grain. However, when the coating layer was so thinned as to implement a carrier whose static resistance was less than 12 log Ω, the life of the carrier was reduced and make charging unstable, disturbing a latent image formed on the drum 1.

As stated above, Experiment 10 showed that when the static resistance of the carrier was between 12 log Ω and 14 log Ω, carrier scattering out of the developing device 2 was sufficiently reduced.

[Experiment 11]

The toner T and each of the carriers C23 through C25 were mixed together to prepare three developers having a toner content of 5 wt %. Again, the laser printer with the developing device 2 was operated to estimate carrier scattering for 1,000 prints.

FIG. 28 shows the results of Experiment 11. As shown, as for the developing device with the auxiliary pole P1*c* having the replacement angular velocity of 35°, when the developer containing the carrier C24 having the fluidity of 25 sec/50 g was used, 6.3 mg of carrier grains flew out for 1,000 prints. By contrast, 5.3 mg of carrier grains and 3.5 mg of carrier grains flew out when the carrier C23 with the fluidity of 35 sec/50 g and the carrier C25 were used, respectively. By extended studies, we found that when the fluidity of the carrier was low, carrier scattering out of the developing device was apt to occur, and that fluidity lying in the range of from 20 sec/50 g to 40 sec/50 g reduced carrier scattering while insuring high image quality. This will be described more specifically hereinafter.

For a given magnet roller 5, the length and density of the magnet brush vary in accordance with the fluidity of the developer or that of the carrier, noticeably effecting image quality. More specifically, when fluidity is low, i.e., the developer is dry, the developer weakly rises and forms a soft magnet brush to thereby enhance image quality. However, if fluidity is lower than 20 sec/50 g, then carrier scattering is apt to occur while image density is easily lowered.

Carrier fluidity above 40 sec/50 g, which lowers developer fluidity, makes the magnet brush harder and more dense and thereby degrades the tonality of an image and the reproducibility of halftone. This is presumably because the hard, dense brush portion strongly rubs the surface of the drum 1.

As stated above, Experiment 11 showed that when carrier fluidity was between 20 sec/50 g and 40 sec/50 g, carrier scattering was effectively reduced while image density and tonality were enhanced.

As for a relation between developer fluidity and carrier fluidity, developer fluidity is higher than carrier fluidity by 9.8 sec/50 g in average as far as the carriers C19 through C27 are concerned. It follows that if carrier fluidity is between 30 sec/50 g and 50 sec/50 g, preferably between 30 sec/50 g and 45 sec/50 g, then it is also possible to enhance tonality and halftone reproducibility while reducing carrier scattering.

[Experiment 12]

The toner T and each of the carriers C26 and C27 were mixed together to prepare two developers having a toner content of 5 wt %. The amount of charge deposited on toner was 10.2 $\mu$C/g in the case of the developer containing the carrier C26 or 39.7 $\mu$C/g in the case of the developer containing the carrier C27. The developers had a fluidity of 43 sec/50 g each. Again, the laser printer with the developing device 2 was operated to estimate carrier scattering for 1,000 prints as in Experiment 9.

FIG. 29 lists the results of Experiment 12. As shown, as for the developing device with the auxiliary pole P1*b* having the placement angle of 35°, when the developer consisting of the carrier C27 and toner charged to 39.7 $\mu$C/g was used, 4.7 mg of carrier grains flew out of the developing device. By contrast, the amount of toner grains flew out was 3.3 mg when use was made of the developer consisting of the carrier C26 and toner charged to 10.2 $\mu$C/g. By extended studies, we found that when the amount of charge deposited on the toner was great, carrier scattering was apt to occur, and that when the amount of charge was between 10 $\mu$C/g and 40 $\mu$C/g, carrier scattering was effectively reduced while insuring high image quality. This will be described more specifically hereinafter.

The toner deposited on the drum 1 exerts an electrostatic force that attracts the carrier in the developing zone toward the drum 1 and increases with an increase in the amount of charge deposited on the toner. Presumably, therefore, when the amount of charge deposited on the toner is great, the carrier is easily attracted toward and deposited on the drum 1. If the amount of charge deposited on the toner is 10 $\mu$C/g or below, then adhesion acting between the toner and the carrier is so weak, the toner is apt to fly about. In addition, the mobility of the toner toward the latent image on the drum 1 is short in the developing zone, resulting in low image density.

On the other hand, if the amount of charge deposited on the toner is above 40 $\mu$C/g, then adhesion acting between the toner and the carrier is so strong and makes it difficult for the toner to part from the carrier. As a result, the carrier is apt to move toward the drum 1 together with the toner in the developing zone and fly about.

As stated above, Experiment 12 showed that when the amount of charge deposited on the toner is between 10 C/g and 40 C/g, not only carrier scattering was effectively reduced, but also attractive images free from short image density and other defects were achievable.

As stated above, the illustrative embodiment achieves various advantages, as enumerated below.

(1) Even when the illustrative embodiment is applied to a high-speed machine, it is possible to reduce carrier scattering for thereby enhancing the reproducibility of thin lines and reducing the omission of the trailing edge of an image.

(2) The carrier grains are prevented from flying away from the magnet brush despite the composite force stated earlier and therefore fly out of the developing device little.

What is claimed is:

1. A developing device, comprising:

a developing zone containing a) a developer carrier whose surface is movable while carrying a developer comprising toner grains and magnetic grains, and b) an image carrier whose surface is movable while carrying a latent image thereon, wherein said developer carrier and said image carrier face each other, wherein said developer is capable of rising in a form of a magnet brush with a magnetic pole for development, and wherein said developer carrier is capable of moving in a same direction as, but at a higher linear velocity than, said image carrier to thereby cause said magnet brush to rub said surface of said image carrier to thereby develop said latent image, wherein a linear velocity of said developer carrier in the developing zone is 150 mm/sec or above, but below 500 mm/sec, wherein an amount of the developer deposited on said developer carrier and conveyed to the developing zone is between 65 mg/cm$^2$ and 95 mg/cm$^2$, wherein a magnetic flux generated on the surface of said developer carrier in the developing zone by the magnetic pole for development has a flux density having an attenuation ratio of 40% in a direction normal to said surface of said developer carrier, wherein the flux density in the direction normal to the surface of said developer carrier, as measured on said surface of said developer carrier, is between 100 mT and 200 mT, and wherein the magnetic grains have a saturation magnetization value of $40\times10^{-7}\times4\ \pi$Wb·m/kg or above, but below $50\times10^{-7}\times4\ \pi$Wb·m/kg.

2. The device as claimed in claim 1, wherein the magnetic grains have a fluidity of at least 20 sec/50 g or above, but not more than 40 sec/50 g or below.

3. The device as claimed in claim 2, wherein the toner grains are charged by an amount of at least 10 $\mu$C/g or above, but not more than 40 $\mu$C/g or below.

4. The device as claimed in claim 1, wherein the magnetic grams have a static resistance of at least 12 log Ω or above, but not more than 14 log Ω or below.

5. The device as claimed in claim 4, wherein the magnetic grains have a fluidity of at least 20 sec/50 g or above, but not more than 40 sec/50 g or below.

6. The device as claimed in claim 5, wherein the toner grains are charged by an amount of at least 10 $\mu$C/g or above, but not more than 40 $\mu$C/g or below.

7. A developing device, comprising:

a developing zone containing a) a developer carrier whose surface is movable while carrying a developer comprising toner grains and magnetic grains, and b) an image carrier whose surface is movable while carrying a latent image thereon, wherein said developer carrier and said image carrier face each other, wherein said developer is capable of rising in a form of a magnet brush with a magnetic pole for development, and wherein said developer carrier is capable of moving in a same direction as, but at a higher linear velocity than, said image carrier to thereby cause said magnet brush to rub said surface of said image carrier to thereby develop said latent image, wherein a linear velocity of said developer carrier in the developing zone is 150 mm/sec or above, but below 500 mm/sec, wherein an amount of the developer deposited on said developer carrier and conveyed to the developing zone is between 65 mg/cm$^2$ and 95 mg/cm$^2$, wherein, when half-value points on a surface of said developer carrier, where a flux density is one-half of a peak value of a flux density generated by the magnetic pole for development on said surface of said developer carrier in a direction normal to said surface of said developer carrier, are seen from a curvature axis of said surface of said develoner carrier, an angular width between said half-value points in a direction of movement of said surface of said developer carrier is 25° or less, wherein the flux density in the direction normal to the surface of said developer carrier is between 100 mT and 200 mT on said surface of said developer carrier, and wherein the magnetic grains have a saturation magnetization value of $40\times10^{-7}\times4$ ππWb·m/kg or above, but below $60\times10^{-7}\times4$ Wb·m/kg.

8. The device as claimed in claim 7, wherein the magnetic grains have a fluidity of at least 20 sec/50 g or above, but not more than 40 sec/50 g or below.

9. The device as claimed in claim 8, wherein the toner grains are charged by an amount of at least 10 $\mu$C/g or above, but not more than 40 $\mu$C/g or below.

10. The device as claimed in claim 7, wherein the magnetic grains have a static resistance of at least 12 log Ω or above, but not more than 14 log Ω or below.

11. The device as claimed in claim 10, wherein the magnetic grains have a fluidity of at least 20 sec/50 g or above, but not more than 40 sec/50 g or below.

12. The device as claimed in claim 11, wherein the toner grains are charged by an amount of at least 10 $\mu$C/g or above, but not more than 40 $\mu$C/g or below.

13. An image forming apparatus, comprising:

an image carrier;

latent image forming means for forming a latent image on said image carrier;

developing means for developing the latent image with a developer comprising toner grains and magnetic grains to thereby form a toner image; and image transferring means for transferring the toner image from said image carrier to a recording medium;

said image carrier having a surface movable, in a developing zone where said surface of said image carrier and a surface of a developer carrier included in said developing means face each other, at a linear velocity of at least 100 mm/sec or above, but not more than 300 mm/sec or below;

wherein in said developing means a linear velocity of said developer carrier in the developing zone is 150 mm/sec or above, below 500 mm/sec, wherein an amount of the developer deposited on said developer carrier and conveyed to the developing zone is between 65 mg/cm$^2$ and 95 mg/cm$^2$, wherein a magnetic flux generated on the surface of said developer carrier in the developing zone by a magnetic pole for development has a flux density having an attenuation ratio of 40% in a direction normal to said surface of said developer carrier, wherein the flux density in the direction normal to the surface of said developer carrier, as measured on said surface of said developer carrier is between 100 mT and 200 mT, and wherein the magnetic grains have a saturation magnetization value of $40\times10^{-7}\times4$ πWb·m/kg or above, but below $50\times10^{-7}\times4$ πWb·m/kg.

14. An image forming apparatus, comprising:

an image carrier;

latent image forming means for forming a latent image on said image carrier;

developing means for developing the latent image with a developer comprising toner grains and magnetic grains to thereby form a toner image; and image transferring means for transferring the toner image from said image carrier to a recording medium;

said image carrier having a surface movable, in a developing zone where said surface of said image carrier and a surface of a developer carrier included in said developing means face each other, at a linear velocity of at least 100 mm/sec or above, but not more than 300 mm/sec or below;

wherein in said developing means a linear velocity of said developer carrier in the developing zone is 150 mm/sec or above, but below 500 mm/sec, wherein an amount of the developer deposited on said developer carrier and conveyed to the developing zone is between 65 mg/cm$^2$ and 95 mg/cm$^2$, wherein a linear velocity of said developer carrier in the developing zone is 150 mm/sec or above, but below 500 mm/sec, wherein an amount of the developer deposited on said developer carrier and conveyed to the developing zone is between 65 mg/cm$^2$ and 95 mg/cm$^2$, wherein when half-value points on the surface of said developer carrier, where a flux density is one-half of a peak value of a flux density generated by a magnetic pole for development on said surface of said developer carrier in a direction normal to said surface of said developer carrier, are seen from a curvature axis of said surface of said developer carrier, an angular width between said half-value points in a direction of movement of said surface of said developer carrier is 25° or less, wherein the flux density in the direction normal to the surface of said developer carrier is between 100 mT and 200 mT on said surface of said developer carrier, and wherein the magnetic grains have a saturation magnetization value of $40\times10^{-7}\times4$ ππWb·m/kg or above, but below $60\times10^{-7}\times4$ Wb·m/kg.

15. A developing device, comprising:

a developing zone containing a) a developer carrier whose surface is movable while carrying a developer comprising toner grains and magnetic grains, and b) an image carrier whose surface is movable while carrying a latent image thereon, wherein said developer carrier and said image carrier face each other, wherein said developer is capable of rising in a form of a magnet brush with a magnetic pole for development, and wherein said developer carrier is capable of moving in a same direction as, but at a higher linear velocity than, said image carrier to thereby cause said magnet brush to rub said surface of said image carrier to thereby develop said latent image, wherein a linear velocity of said developer carrier in the developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein a magnetic flux generated on the surface of said developer carrier in the developing zone by the magnetic pole for development has a flux density having an attenuation ratio of 40% in a direction normal to said surface of said developer carrier, wherein the flux density in the direction normal to the surface of said developer carrier, as measured on said surface of said developer carrier, is between 100 mT and 200 mT, and wherein the magnetic grains have a saturation magnetization value of $60\times10^{-7}\times4\ \pi$Wb·m/kg or above, but below $90\times10^{-7}\times4\ \pi$Wb·m/kg.

16. The device as claimed in claim 15, wherein the magnetic grains have a fluidity of at least 20 sec/50 g or above, but not more than 40 sec/50 g or below.

17. The device as claimed in claim 16, wherein the toner grains are charged by an amount of at least 10 $\mu$C/g or above, but not more than 40 $\mu$C/g or below.

18. The device as claimed in claim 15, wherein the magnetic grains have a static resistance of at least 12 log Ω or above, but not more than 14 log Ω or below.

19. The device as claimed in claim 18, wherein the magnetic grains have a fluidity of at least 20 sec/50 g or above, but not more than 40 sec/50 g or below.

20. The device as claimed in claim 19, wherein the toner grains are charged by an amount of at least 10 $\mu$C/g or above, but not more than 40 $\mu$C/g or below.

21. A developing device, comprising:

a developing zone containing a) a developer carrier whose surface is movable while carrying a developer comprising toner grains and magnetic grains, and b) an image carrier whose surface is movable while carrying a latent image thereon, wherein said developer carrier and said image carrier face each other, wherein said developer is capable of rising in a form of a magnet brush with a magnetic pole for development, and wherein said developer carrier is capable of moving in a same direction as, but at a higher linear velocity than, said image carrier to thereby cause said magnet brush to rub said surface of said image carrier to thereby develop said latent image, wherein a linear velocity of said developer carrier in the developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein, when half-value points on a surface of said developer carrier, where a flux density is one-half of a peak value of a flux density generated by the magnetic pole for development on said surface of said developer carrier in a direction normal to said surface of said developer carrier, are seen from a curvature axis of said surface of said developer carrier, an angular width between said half-value points in a direction of movement of said surface of said developer carrier is 25° or less, wherein the flux density in the direction normal to the surface of said developer carrier, as measured on said surface of said developer carrier, is between 100 mT and 200 mT, and wherein the magnetic grains have a saturation magnetization value of $60\times10^{-7}\times4\ \pi$Wb·m/kg or above, but below $90\times10^{-7}\times4\ \pi$Wb·m/kg.

22. The device as claimed in claim 21, wherein the magnetic grains have a fluidity of at least 20 sec/50 g or above, but not more than 40 sec/50 g or below.

23. The device as claimed in claim 22, wherein the toner grains are charged by an amount of at least 10 $\mu$C/g or above, but not more than 40 $\mu$C/g or below.

24. The device as claimed in claim 21, wherein the magnetic grains have a static resistance of at least 12 log Ω or above, but not more than 14 log Ω or below.

25. The device as claimed in claim 24, wherein the magnetic grains have a fluidity of at least 20 sec/50 g or above, but not more than 40 sec/50 g or below.

26. The device as claimed in claim 25, wherein the toner grains are charged by an amount of at least 10 $\mu$C/g or above, but not more than 40 $\mu$C/g or below.

27. An image forming apparatus, comprising:

an image carrier;

latent image forming means for forming a latent image on said image carrier;

developing means for developing the latent image with a developer comprising toner grains and magnetic grains to thereby form a toner image; and image transferring means for transferring the toner image from said image carrier to a recording medium;

said image carrier having a surface movable, in a developing zone where said surface of said image carrier and a surface of a developer carrier included in said developing means face each other, at a linear velocity of at least 300 mm/sec or above, but not more than 600 mm/sec or below;

wherein in said developing means a linear velocity of said developer carrier in the developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein a magnetic flux generated on the surface of said developer carrier in the developing zone by a magnetic pole for development has a flux density having an attenuation ratio of 40% in a direction normal to said surface of said developer carrier, wherein the flux density in the direction normal to the surface of said developer carrier, as measured on said surface of said developer, is between 100 mT and 200 mT, and wherein the magnetic grains have a saturation magnetization value of $60\times10^{-7}\times4\ \pi$Wb·m/kg or above, but below $90\times10^{-7}\times4\ \pi$Wb·m/kg.

28. An image forming apparatus comprising:

an image carrier;

latent image forming means for forming a latent image on said image carrier;

developing means for developing the latent image with a developer comprising toner grains and magnetic grains to thereby form a toner image; and image transferring means for transferring the toner image from said image carrier to a recording medium;

said image carrier having a surface movable, in a developing zone where said surface of said image carrier and a surface of a developer carrier included in said developing means face each other, at a linear velocity of at least 300 mm/sec or above, but not more than 600 mm/sec or below;

wherein in said developing means a linear velocity of said developer carrier in the developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein, when half-value points on the surface of said developer carrier, where a flux density is one-half of a peak value of a flux density generated by a magnetic pole for development on said surface of said developer carrier in a direction normal to said surface of said developer carrier, are seen from a curvature axis of said surface of said developer carrier, an angular width between said half-value points in a direction of movement of said surface of said developer carrier is 25° or less, wherein the flux density in the direction normal to the surface of said developer carrier, as measured on said surface of said developer carrier, is between 100 mT and 200 mT, and wherein the magnetic grains have a saturation magnetization value of $60\times10^{-7}\times4\ \pi$Wb·m/kg or above, but below $90\times10^{-7}\times4\ \pi$Wb·m/kg.

29. A developing device, comprising:

a developing zone containing a) a developer carrier whose surface is movable while carrying a developer comprising toner grains and magnetic grains, and b) an image carrier whose surface is movable while carrying a latent image thereon, wherein said developer carrier and said image carrier face each other, wherein said developer is capable of rising in a form of a magnet brush with a magnetic pole for development, and wherein said developer carrier is capable of moving in a same direction as, but at a higher linear velocity than, said image carrier to thereby cause said magnet brush to rub said surface of said image carrier to thereby develop said latent image, wherein a linear velocity of said developer carrier in the developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein an auxiliary magnetic pole is positioned downstream of, but adjacent, said magnetic pole for development in a direction of movement of the surface of said developer carrier such that a magnetic flux generated on the surface of said developer carrier in the developing zone by the magnetic pole for development has a flux density having an attenuation ratio of 40% in a direction normal to said surface of said developer carrier, and wherein a casing included in, said developing device is configured to cover the developer caused to rise by said auxiliary magnetic pole.

30. The device as claimed in claim 29, wherein the magnetic grains have a fluidity of at least 20 sec/50 g or above, but not more than 40 sec/50 g or below.

31. The device as claimed in claim 30, wherein the toner grains are charged by an amount of at least 10 $\mu$C/g or above, but not more than 40 $\mu$C/g or below.

32. The device as claimed in claim 29, wherein the magnetic grains have a static resistance of at least 12 log Ω or above, but not more than 14 log Ω or below.

33. The device as claimed in claim 32, wherein the magnetic grains have a fluidity of at least 20 sec/50 g or above, but not more than 40 sec/50 g or below.

34. The device as claimed in claim 33, wherein the toner grains are charged by an amount of at least 10 $\mu$C/g or above, but not more than 40 $\mu$C/g or below.

35. A developing device, comprising:

a developing zone containing a) a developer carrier whose surface is movable while carrying a developer comprising toner grains and magnetic grains, and b) an image carrier whose surface is movable while carrying a latent image thereon, wherein said developer carrier and said image carrier face each other, wherein said developer is capable of rising in a form of a magnet brush with a magnetic pole for development, and wherein said developer carrier is capable of moving in a same direction as, but at a higher linear velocity than, said image carrier to thereby cause said magnet brush to rub said surface of said image carrier to thereby develope said latent image, wherein a linear velocity of said developer carrier in the developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein auxiliary magnetic poles are positioned at both sides of said magnetic pole for development in a direction of movement of the surface of said developer carrier such that a magnetic flux generated on the surface of said developer carrier in the developing zone by the magnetic pole for development has a flux density having an attenuation ratio of 40% in a direction normal to said surface of said developer carrier, wherein at least one of said auxiliary magnetic poles is positioned such that a normal line on the surface of said developer carrier where a flux density generated by said at least one auxiliary magnetic pole has a peak value on said surface of said developer carrier is directed downward in a vertical direction, and wherein a casing included in, said developing device is configured to cover the developer caused to rise by said at least one of said auxiliary magnetic poles.

36. The device as claimed in claim 35, wherein the magnetic grains have a fluidity of at least 20 sec/50 g or above, but not more than 40 sec/50 g or below.

37. The device as claimed in claim 36, wherein the toner grains are charged by an amount of at least 10 $\mu$C/g or above, but not more than 40 $\mu$C/g or below.

38. The device as claimed in claim 35, wherein the magnetic grains have a static resistance of at least 12 log Ω or above, but not more than 14 log Ω or below.

39. The device as claimed in claim 38, wherein the magnetic grains have a fluidity of at least 20 sec/50 g or above, but not more than 40 sec/50 g or below.

40. The device as claimed in claim 39, wherein the toner grains are charged by an amount of at least 10 $\mu$C/g or above, but not more than 40 $\mu$C/g or below.

41. An image forming apparatus comprising:

an image carrier;

latent image forming means for forming a latent image on said image carrier;

developing means for developing the latent image with a developer comprising toner grains and magnetic grains to thereby form a toner image; and image transferring means for transferring the toner image from said image carrier to a recording medium;

wherein in said developing means a linear velocity of a developer carrier in a developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein an auxiliary magnetic pole is positioned downstream of, but adjacent, a magnetic pole for development in a direction of movement of the surface of said developer carrier such that a magnetic flux generated on said surface of said developer carrier in the developing zone by said magnetic pole for development has a flux density having an attenuation ratio of 40% in a direction normal to said surface of said developer carrier, and wherein a casing included in, said developing means is configured to cover the developer caused to rise by said auxiliary magnetic pole.

42. An image forming apparatus comprising:

an image carrier;

latent image forming means for forming a latent image on said image carrier;

developing means for developing the latent image with a developer comprising toner grains and magnetic grains to thereby form a toner image; and image transferring means for transferring the toner image from said image carrier to a recording medium;

wherein in said developing means a linear velocity of a developer carrier in a developing zone is 500 mm/sec or above, but below 1,200 mm/sec, wherein an amount of the developer deposited on said developer carrier and conveyed to the developing zone is between 65 mg/cm$^2$ and 95 mg/cm$^2$, wherein auxiliary magnetic poles are positioned at both sides of a magnetic pole for development in a direction of movement of the surface of said developer carrier such that a magnetic flux generated on said surface of said developer carrier in the developing zone by said magnetic pole for development has a flux density having an attenuation ratio of 40% in a direction normal to said surface of said developer carrier, wherein at least one of said auxiliary magnetic poles is positioned such that a normal line on the surface of said developer carrier where a flux density generated by said at least one auxiliary magnetic pole has a peak value on said surface of said developer carrier is directed downward in a vertical direction, and wherein a casing included in, said developing means is configured to cover the developer caused to rise by said at least one of said auxiliary magnetic poles.

* * * * *